US007730856B2

(12) United States Patent
Van Avermaete

(10) Patent No.: US 7,730,856 B2
(45) Date of Patent: Jun. 8, 2010

(54) ENGINE WITH VARIABLE VOLUMETRIC RATIO

(75) Inventor: Gilbert Lucien Charles Henri Louis Van Avermaete, 2 A, rue de Zoufftgen, Hellange, Grand Duche De Luxembourg (LU) L-3333

(73) Assignee: Gilbert Lucien Charles Henri Louis Van Avermaete, Grand Duche De (LU)

( * ) Notice: Subject to any disclaimer, the term of this patent is extended or adjusted under 35 U.S.C. 154(b) by 0 days.

(21) Appl. No.: 12/176,090

(22) Filed: Jul. 18, 2008

(65) Prior Publication Data

US 2009/0020103 A1 Jan. 22, 2009

Related U.S. Application Data

(63) Continuation-in-part of application No. PCT/BE2007/000008, filed on Jan. 15, 2007.

(30) Foreign Application Priority Data

Jan. 23, 2006 (BE) ..... 2006/0047

(51) Int. Cl.
*F02B 75/04* (2006.01)
*F02B 75/28* (2006.01)

(52) U.S. Cl. ..... 123/48 B; 123/51 AA; 123/78 F

(58) Field of Classification Search ..... 123/48 R, 123/48 B, 48 D, 51 R, 51 A, 51 AA, 78 R, 123/78 D, 78 E, 78 F
See application file for complete search history.

(56) References Cited

U.S. PATENT DOCUMENTS

| | | | | |
|---|---|---|---|---|
| 2,137,941 | A * | 11/1938 | Helmore et al. | 123/51 R |
| 3,961,607 | A | 6/1976 | Brems | |
| 4,876,992 | A | 10/1989 | Sobotowski | |
| 5,638,777 | A | 6/1997 | Van Avermaete | |

FOREIGN PATENT DOCUMENTS

| | | |
|---|---|---|
| CA | 2 339 315 A1 | 8/2002 |
| FR | 1 032 534 A | 7/1953 |
| WO | 94/21905 A1 | 9/1994 |

* cited by examiner

*Primary Examiner*—Noah Kamen
(74) *Attorney, Agent, or Firm*—Sughrue Mion, PLLC

(57) ABSTRACT

Four-stroke internal combustion engine comprising a housing component having a first series of cylinders, each with an axis and a diameter, and a second series of cylinders, each with an axis and a diameter, in which each cylinder of the first series communicates with at least one cylinder of the second series via a channel which is provided by the housing component.

37 Claims, 10 Drawing Sheets

*Figure 8A*

Engine inverted V (A)
Large cylinder perpendicular to cylinder head

↓

Piston small cylinder
With boss (A1) or travel in cylinder head (A2)

↓

Coupling housing / cylinder housing
Separable (A3) or not separable (A4)

↓

Variably timed transmission / small-stroke crankshaft
Separable (A5) or not separable (A6)

↓

Oil sump enclosing
The two crankshafts (A7) or only the large stroke crankshaft (A8)

*Figure 8B*

Engine inverted V (B)
Cylinders not perpendicular to cylinder head

↓

Pistons
Truncated (B1) or travel in cylinder head (B2)

↓

Coupling housing / cylinder housing
Separable (B3) or not separable (B4)

↓

Variably timed transmission / small-stroke crankshaft
Separable (B5) or not separable (B6)

↓

Oil sump enclosing
The two crankshafts (B7) or only the large stroke crankshaft (B8)

A = Direction of the large-stroke crankshaft
B = Direction of the short-stroke crankshaft
C = First cylinder
D = Last cylinder
E = Side to the exhaust manifold

ENGINE WITH VARIABLE VOLUMETRIC RATIO

The present application is a CIP application of PCT/BE 2007/000008 filed on Jan. 15, 2007, published on Jul. 26, 2007 under number WO 2007/082355 and claiming the priority of Belgian patent application 2006/0047 filed on Jan. 23, 2006.

SPECIFICATION

The discovery relates to the regularisation of the engine torque stress between two crankshafts of a variable compression ratio motor, and to the layout of a combustion chamber created from pairs of cylinders.

TECHNICAL DOMAIN OF INVENTION

The present invention concerns the creation of variably timed transmission for a variable compression ratio motor in order to improve the control mechanism for the phase angle between a first crankshaft and a second crankshaft. This technique is defined by a new form of spacing between the two crankshafts, in such a way as to bring about the projection of the variably timed transmission's coupling next to the engine's flywheel. The variably timed transmission's control is provided with a guidance cylinder, which is directly connected, in order to monitor the phase angle between the short-stroke crankshaft and the long-stroke crankshaft. Means are provided to permit the reduction, or preferably the elimination, of any engine torque stress transfers not regulated by the small crankshaft onto the large crankshaft. Other resources are also provided in the crankcase by a new layout of the two paired cylinders, making it possible to constitute a combustion chamber common to these two cylinders at their top dead centre. Likewise, this new layout of the two paired cylinders in the crankcase authorises the disencumbrance of the two couplings of the two crankshafts, this means making it possible to standardise the connecting rod head-foot centreline distance on the coupling of the large crankshaft.

Patent EP0689642B1 describes a four-stroke variable compression ratio engine, designed with two crankshafts, a large-stroke crankshaft and a short-stroke crankshaft. It is known that the crankshaft of an internal combustion engine constitutes an element likely to vibrate naturally under torque, by reason of its flexibility, together with the masses of the organs under stress, which are linked to it directly or indirectly. In the description of the above-mentioned patent EP0689642B1, the short-stroke crankshaft does not include a stress regulation flywheel. Consequently, unregulated engine torque stresses accumulate at the variably timed transmission output, and generate vibrations caused by the short-stroke crankshaft on the long-stroke crankshaft. For this reason, the calculation of the long-stroke crankshaft's resistance is then inherently linked to the torque stresses coming from its own cylinders, but also to the torque stresses coming from the cylinders of the short-stroke crankshaft.

In patent EP 0689642 B1 the parallel connection of the two paired cylinders leads to the limitation of the lateral space required for the mobility of the two crankshafts; using this approach, the engine's architecture calls for a vertical distancing of the two crankshafts by means of short connecting rods (connecting rods with short centreline distances) on the short-stroke crankshaft and long connecting rods (connecting rods with long centreline distances) on the long-stroke crankshaft, which means the crankcase height needs to be increased. It is also known that, for the same crank angle between the top dead centre and the bottom dead centre, the linear displacement of a piston orientated around a short connecting rod is as much faster in the vicinity of the top dead centre as in the vicinity of the bottom dead centre. Logically, we can discern that a long connecting rod on the long-stroke crankshaft displays less obliqueness in its turning movement. It follows that the first quarter-turn of the expansion phase of the gases, the linear travel of the piston of the long-stroke crankshaft is reduced in relation to its turning movement.

This invention relates to the concept of an engine having a variable compression ratio, which consists in varying the volume of the combustion chamber in function of the intake air density and temperature, the engine speed and the engine temperature, in order to produce a hypersupercharging effect on the engine by means of a single or double supercharging pressure with intercooling.

The present invention describes a new combination of a four-stroke engine having a variable volume combustion chamber. The engine advantageously comprises a kinematic chain, in which the shafts of the two crankshafts are coupled, at the same rotational speed, to the variably timed transmission system. The angular displacement between the two crankshafts, accomplished between the start-of-travel and the end-of-travel of the variable timing, has been brought about through an appropriate relationship between the two displacements of the two paired cylinders and between the volume of the latter and the clearance space, which makes it possible to modulate the compression ratio of the engine through the linear displacement of the piston of the small cylinder in relation to the phases of the engine.

The supercharging principle of piston engines consists in increasing the air masses without increasing the displacement. For constant compression ratio engines, this results in an increase of the combustion pressure and a higher specific output (with reference to the cylinder volume in litres). However, when the supercharging pressure is increased, the mechanical and thermal stresses increase on the engine members. This main drawback is due to the fact that the compression ratio generated by the combustion chamber and the piston stroke cannot be altered and adapted to pressure and temperature variations of the intake air and to variations in engine speeds and temperatures.

Consequently, engine manufacturers respect certain design rules by defining, on the one hand, a limit to the amplitude of intake pressure variations and, on the other hand, by achieving an average compression ratio between the atmospheric intake pressure and the supercharging pressure. Since the fact of defining an average compression ratio is a compromise, which conciliates at best the different engine loads, and speeds, the pressures and temperatures of the atmospheric intake are too low and the supercharging pressures and temperatures are too high.

The subject of the invention is a four-stroke internal combustion engine comprising at least one intake phase, a compression phase, an expansion phase and an exhaust phase, the said engine functioning by self-ignition or by spark ignition means comprising:

- a crankcase component having a first series of cylinders (2) each having a shaft and a diameter, and a second series of cylinders (3) each having a shaft and a diameter, with the cylinders (2) of the first series having a larger displacement and a larger diameter than the displacement and the diameter of the cylinders (3) of the second series,
- pistons (6,8), each piston being adapted to be driven by an alternative movement in a cylinder and being associated with a connecting rod, two crankshafts with rotational axes parallel to one another, a first crankshaft having a crank with a large stroke, whilst the second crankshaft has a crank with a small stroke, less than the long stroke of the crank of the first crankshaft, the said crankshafts being adapted to be coupled at the same rotational speed, by means of at least a gear train, at least one variably timed transmission acting on an element selected from the group consisting of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod (7,9), is operated with a crank of a crankshaft, the short-stroke crank of the second crankshaft (5) operating the connecting rod (9) of the piston (8) moving in the small cylinder (3), whilst the long-stroke crank of the first crankshaft (4) operates the connecting rod (7) of the piston (6) moving in the large cylinder (2), in which the first series of cylinders (2) is positioned above the first crankshaft (4), whilst the second series of cylinders (3) is positioned above the second crankshaft (5), and in which each cylinder (2) of the first series communicates with at least one cylinder (3) of the second series via a clearance space, in such a way as to form a group of two cylinders (2,3) communicating between themselves in order to allow the gases to pass from one cylinder to the other, independently of the position of the pistons (6,8) moving in the said cylinders (2,3).

The engine of the invention is advantageously as disclosed in any one of the attached claims.

In the engine according to the invention, the crankcase component advantageously has a face along which the cylinders are advantageously open along the face of the cylinder head gasket plane, with channels and passages being formed in the face of the crankcase facing the cylinder head gasket plane in order to form at least one distinct passage or channel for each cylinder group, with a group's channel or passage extending between a cylinder from the first series and a cylinder from the second series, with the said channel having a mean and/or minimal width (width determined in the cylinder head gasket plane) advantageously between 0.5 and 0.8 times) the mean of the diameters of the cylinders linked by the channel or passage in question.

Advantageously, for an engine in which, for each group of cylinders linked to one another by a channel or passage, the axis of a cylinder from the first series of the group in question forms a first plane with a straight line parallel to the axis of rotation of a crankshaft, whilst the axis of the cylinder from the second series of the group in question forms a second plane with a straight line parallel to the axis of rotation of a crankshaft, the said planes define between them an angle between 1° and 60° (advantageously between 100 and 50°, preferably between 150 and 45°).

The axes of the cylinders of a group preferably intersect roughly at a point.

According to a specific embodiment in which a plane is defined by the two axes of rotation of the two crankshafts, and in which a median plane or a median straight line is defined between the said first and second planes or between the said axes of rotation, the median plane or the median straight line of a group of cylinders is roughly perpendicular to the said plane defined by the two axes of rotation of the two crankshafts.

According to an advantageous detail of an engine according to the invention, the volume of the channel located between two cylinders of a group is between 1% and 25%, in particular 2% to 15%, of the total clearance volume of the group in question, the said total clearance volume being defined by the total free volume of the group with the two pistons in the top dead centre position.

According to another detail of a specific embodiment, the motor includes a camshaft which at half-speed is engaged with the first crankshaft (4) in order to ensure the periodic communication of the groups of two cylinders (2,3) with intake and exhaust ducts via intake and exhaust valves at pre-determined moments in the four-stroke cycle.

In an advantageous embodiment, the engine includes a layout for variably timed transmission, with the said layout being adapted to receive, at least in part, a device controlling the phase angle difference between the first and second crankshafts.

Preferably, when the first and second crankshafts are associated, respectively, with a first drive wheel and a second drive wheel, a means of driving extends between the said wheels.

In particular, when an engine flywheel is mounted on the axis of the long-stroke crankshaft, whilst the variably timed transmission is mounted on the axis of the short-stroke crankshaft, the distance separating the axes of the two crankshafts is sufficient, in such a way that the variably timed transmission is located next to the engine flywheel.

For example, the variably timed transmission control comprises a direct contact guidance cylinder to monitor the phase angle difference between the short-stroke crankshaft and the long-stroke crankshaft.

According to a possible embodiment, the engine including a variably timed transmission system includes a separate assembly for the short-stroke crankshaft. The variably timed transmission is fitted with a bearing plate, which is fixed by being centred in a bore provided in the crankcase. The variably timed transmission includes a shaft, one end of which has external grooves, whilst the shaft is associated with an element, or has a portion displaying a hollow, with internal grooves adapted to co-operate with the external grooves of the shaft to ensure that the shafts are coupled to one another, while still allowing some axial movement between them.

The shaft (13) is preferentially associated with a bearing coupling (20) having internal grooves co-operating with the external grooves of the shaft (12).

In another possible embodiment, the engine includes a means of reinforcing the axial rigidity between the short-stroke crankshaft (5) and the variably timed transmission (10), the shafts (12 and 13) are merged into a single shaft, in such a way as to allow the transmission shaft (35) including the disc (40) and the straight grooves (47) to become associated with the short-stroke crankshaft (5). The separation distance between the disc fastening supports (40) and the bearing plate (15) is equal to the separation distance between the fastening of the crankcase (1) of the bearing plate (15) and the fastening support of the disc (40) when the short-stroke crankshaft is inserted into the bearing plates of the crankcase. From this assembly an axial fastening results for the short-stroke crankshaft (5) via the bearing (39) and a radial fastening for the sleeve (36) via the bearing plates of the short-stroke crankshaft (5).

In accordance with a characteristic of a specific embodiment in which the cylinder head gasket extends roughly in a plane, in relation to the cylinder head plane, the axis of the cylinders of the first series is positioned, more or less, perpendicularly to the cylinder head gasket plane.

The pistons of the cylinders of the second series are preferably fitted with a boss for rectifying the form of the combustion chamber, the said boss having at least one face more or less parallel to the cylinder head gasket plane.

In particular, the face more or less parallel to the cylinder head gasket plane is equal to at least 25%, advantageously at least 40%, and preferably at least 60% to 90% of the area of the cylinder of the second series measured in the cylinder head gasket plane.

In accordance with another feature, the piston of the cylinder of the first series has a face more or less parallel to the cylinder head gasket plane, the said face having a hollow portion adapted to be open onto a channel.

In a more specific manner, the boss and/or the hollow section is/are adapted to form a clearance volume in the top dead centre position of the piston, with at least one portion adjacent to the channel extending into the cylinder beneath the cylinder head gasket plane without the cylinder head gasket, to a height equal to at least the depth of the channel (32) beneath the cylinder head plane.

In accordance with a detail from another specific embodiment, the engine has a cylinder head adapted to receive a part of the piston, in the top dead centre position, for each cylinder of the second series, and to form, at least partially, a recess, for each cylinder of the second series in the top dead centre position, in a part of the piston going beyond the cylinder head plane or a chamber located in the cylinder housing communicating with the channel.

In accordance with a feature from a specific embodiment, the axes of the cylinders of the first series and the axes of the cylinders of the second series are not positioned perpendicularly to the cylinder head plane.

In advantageous fashion, the pistons of the cylinders of the second series are truncated in a manner which rectifies the form of the combustion chamber, the said pistons having at least one face more or less parallel to the cylinder head gasket plane, in the same way as the pistons of the cylinders are truncated in a manner which rectifies the form of the combustion chamber, the said pistons having at least one face more or less parallel to the cylinder head gasket plane.

In accordance with a feature of another possible specific embodiment, the engine includes an engine flywheel centred and fastened to the end of the crankshaft of the pistons of the cylinders of the first series within a coupling housing.

The variably timed transmission (10) is preferably centred on the end of the small crankshaft (5) beside the engine flywheel (26).

In particular, in the coupling housing, the engine includes a transmission with a gear train between the crankshaft of the pistons of the second series and the engine flywheel, via the variably timed transmission.

In accordance with still another feature of an engine in accordance with the invention, the variably timed transmission includes a tube or shaft sliding axially in relation to the axis of rotation of the crankshaft of the pistons of the second series, whilst the engine includes stop units to limit the movement travel of the variably timed transmission between a start-of travel and an end-of-travel.

In particular, the engine includes a control cylinder controlling the axial displacement of the sliding tube or shaft, the said cylinder being associated with stop units to limit the displacement between the said start-of-travel and end-of-travel, the said control cylinder being advantageously fastened to a support provided on a closing cover of the coupling housing located beside the engine flywheel.

Once again, in accordance with an advantageous detail of a possible specific embodiment, the two crankshafts are associated with direct contact gears, the shafts turning in opposite directions of rotation and at the same speed.

In advantageous fashion, the two crankshafts are coupled to one another by a train of two intermediate coupling gears positioned between the two gears mounted on the shafts in order that the latter should turn in opposite directions of rotation and at the same speed.

Preferably, the two intermediate gears located between the gears mounted on the shafts are advantageously positioned and each coupled on either side of a plane passing through the axes of the two crankshafts.

In one specific embodiment, the engine includes a control cylinder to vary the angular position between the two crankshafts (4,5) without going through the intermediary of the engine flywheel (26) located at the rear of the engine;

According to a preferred embodiment, the variably timed transmission includes a control mechanism to vary the angle of timing of the crank of the second crankshaft in relation to the crank of the first crankshaft, by means of a hydraulic force amplifier comprising a controlled thrustor acting on the variably timed transmission, the said transmission making it possible to modify the engine's compression ratio in the final large cylinder piston compression phase, between a minimal compression ratio and a maximal compression ratio, the said minimal and maximal compression ratios depending on:

a) the relationship between the displacement of the large cylinder and the displacement of the small cylinder, and b) the relationship between, on the one hand, the total volume of the small cylinder and the large cylinder and, on the other hand, the volume of the clearance space and of an additional volume created in the small cylinder in the final large cylinder piston compression phase, with the variably timed transmission regulating the angular feed of the crank of the second crankshaft in relation to the crank of the first crankshaft in order to obtain the said compression ratios, the said angular feed varying between a maximal angular feed such that an angle of at least 90° is formed between the small cylinder piston lever and the crank of the second crankshaft in the final large cylinder piston compression phase in order to define the minimal compression ratio, and a minimal angular feed such that in the final large cylinder piston compression phase the angular feed angle corresponds to the positioning of the large cylinder piston in the small cylinder to create the additional volume required to obtain the maximal compression ratio, the crank of the second line of the crankshaft shaft forming an angle with the small cylinder piston rod.

In accordance with a feature of an engine for which the crank of the first crankshaft shaft passes through a top dead centre and a bottom dead centre during rotation, the two crankshafts are laid out to define a minimum working space for the two crankshafts in such a way that a ratio is obtained for the minimal displacements of the two paired cylinders. The variably timed transmission displays a displacement travel extending between a start-of-travel and an end-of-travel, the minimal compression ratio of two paired cylinders being obtained at the end of the variably timed transmission, this compression ratio being calculated using the following formula:

$$\frac{V1 + [V2 - Vr(\alpha\text{maximum})] + ve}{ve + Va(\alpha\text{maximum})} = P\ \text{minimum}$$

in which

V1=displacement of the larger cylinder of the paired cylinders.

V2=displacement of the smaller cylinder of the paired cylinders.

ve=clearance space of the paired cylinders required for gas transfer between the cylinders without excessive lamination.

($\alpha$ maximum)=lead angle of the crank of the short-stroke crankshaft, at the end-of-travel of the variably timed transmission.

Vr($\alpha$ maximum)=compressed air volume at the end-of-travel of the variably timed transmission, defined by the maximum lead angle of the crank of the short-stroke crankshaft, when the crank of the long-stroke crankshaft is located at its bottom dead centre, at the end of the intake phase.

Va($\alpha$ maximum)=additional volume added to the clearance space (24), at the end-of-travel of the variably timed transmission, defined by the maximum lead angle of the crank of the short-stroke crankshaft, when the crank of the long-stroke crankshaft is located at its top dead centre, at the end of the compression phase.

The variably timed transmission includes three superposed concentric members, i.e. an inner member constituted by a drive shaft, an outer member constituted by a sleeve supporting a gear for coupling the two crankshafts, and an intermediate member located between said inner and outer members and constituted by a tube which slides with respect to said inner and outer members, the sleeve being held in a bearing plate by means of a simple-row bearing.

The shaft of the second crankshaft has one end which abuts one end of the drive shaft, said ends having straight male splines and corresponding female splines, so as to enable their coupling and self-centering of the three members of the variably time transmission with respect to the shaft of the second crankshaft when the bearing plate is engaged in an opening of the cylinder housing, and enable the transmission to be assembled and removed without having to remove the second crankshaft, A bearing has a mounting ring which forms the housing of the outer ring of a bearing, the inner ring of which is mounted on the sleeve so as to hold the drive shaft. A spacer extends between the inner ring of the bearing and the inner ring of the angular contact bearing, said spacer serving to take up the space between said rings and holding axially the ring of the angular contact bearing against a shoulder of the sleeve, while a single nut holds the inner rings of the bearing and of the angular contact bearing and the spacer on the sleeve.

The drive shaft has, on the side of the mounting ring, helical or straight splines onto which the sliding tube is engaged, the inner surface of which has straight splines so as to enable said tube to travel linearly along the drive shaft.

The sliding tube has one end permanently free outside the sleeve, said end being held by an inner ring of a double-row angular contact bearing, the outer ring of said bearing being rigidly connected to a holding member of the thrustor.

The helical splines are arranged so that when the sliding tube travels out of the sleeve, said tube reduces the lead angle between the crank of the second crankshaft and the crank of the first crankshaft.

According to a specific feature, in the case of an engine provided with compression ignition means, the engine comprises at least one fuel injector in the clearance space, the fuel being injected in mesh, at half speed, with the long-stroke crankshaft.

According to a specific feature, in the case of an engine provided with spark ignition means, the engine comprises at least one spark plug in the clearance space, the ignition being achieved through means known as in synchronism, at half speed, with the long-stroke crankshaft.

For example, the engine has a ratio between the displacements of the two paired cylinders (2,3) of between 1/10 and 9/10, advantageously between 1/5 and 3/5.

According to another detail of a specific embodiment, the engine includes an oil sump (27), which encloses the two crankshafts entirely via the underside of the cylinder housing.

In the case of a four-stroke internal combustion engine includes an oil sump positioned below the crankshaft of the first series cylinder pistons, whereas the crankshaft of the second series cylinder pistons is enclosed in the cylinder housing above a face of the cylinder housing and at a level located above the oil sump, the said face being inclined towards the oil sump, the said inclined face being advantageously provided with an access panel to the crankshaft of the second series cylinder pistons.

In the case of a four-stroke internal combustion engine, the engine includes a variably timed transmission control cylinder, the said variably timed transmission being advantageously located in front of the engine without going through the flywheel located at the rear of the engine.

In accordance with still another feature, the four-stroke internal combustion engine has two separate housings, namely a coupling housing and a cylinder housing, so that the afore-mentioned two elements are assembled side by side, in the axial direction of the crankshafts. Advantageously, the engine includes a flywheel, mounted by means of a concentric enclosure orientated around the axis of the large crankshaft. The coupling housing is preferably mobile in relation to the cylinder housing so as to position it, from an angular point of view, on the cylinder housing, using means of fastening positioned, in particular, on the periphery of the abutting parts of the above-mentioned two housings.

According to a detail of another specific embodiment, the four-stroke internal combustion engine includes a coupling housing and a cylinder housing forming a single indivisible element, and an oil sump located below the two above-mentioned housings and adapted to be removed, in such a way that removing the said oil sump also releases the underside of the coupling housing.

Another objective of the invention is to produce an appliance or an apparatus or a machine provided with one or more engines in accordance with the invention.

Some of the features and details of specific embodiments will become clear from the following description.

DESCRIPTION OF PREFERRED EMBODIMENTS

The present invention relates to more appropriate means for the regulation of instantaneous torque levels between the two crankshafts of the variable compression ratio engine.

To achieve this end, the variably timed transmission is coupled to the flywheel of the engine and interposed between the flywheel of the engine and the shaft of the long-stroke crankshaft.

Means are provided to ensure that the displacement of the hydraulic cylinder on the variably timed transmission control causes the angular position between the two shafts of the two crankshafts to vary so that the position can be selected without the slightest axial stress on the shaft of the small crankshaft.

According to the invention, this new engine includes two lines of crankshafts, one with long-stroke cranks, and the other with short-stroke cranks. The two crankshafts are coupled to the flywheel of the engine, with the same rotation speed, by means of a gear train and a variably timed transmission, the coupling pinion of which, being part of the gear train, is angularly displaced in relation to the short-stroke crankshaft, which authorises an infinite number of timing ratios between the two crankshafts, without making it necessary to interrupt the transmission between the latter.

According to the invention, the coupling of the variably timed transmission shaft is located inside the first bearing housing of the short-stroke crankshaft, so as to favour greater axial precision and smaller overall dimensions for the said coupling.

According to the invention, the variably timed transmission is laid out and fastened in the cylinder housing in such a way that the variably timed transmission coupling can project into the coupling housing beside the flywheel of the engine. The variably timed transmission is designed in such a way that it can be separated from the engine housing independently of the small-stroke crankshaft, the large-stroke crankshaft and the flywheel of the engine.

A coupling housing closing cover can advantageously be provided next to the engine flywheel, the said closing cover also acting as a fastening support for the variably timed transmission guiding cylinder. The removal of the coupling housing closing cover makes the variably timed transmission fastened to the cylinder housing accessible. The variably timed transmission is removed from the cylinder housing as an interchangeable mechanical assembly without its being necessary to remove the coupling housing.

According to the invention, the two paired cylinders, differentiated by their displacement, are laid out in the form of an inverted V. The two paired cylinders are attached by their top dead centres to form a common combustion chamber in the cylinder housing, in order to let the gases pass from one of these cylinders to the other, independently of the position of the pistons. The engine can also have several pairs of two cylinders, with each of the cylinders being located above one of the two lines of crankshafts. The short-stroke crankshaft crank operates with the rod of the smaller cylinder's piston, with the crank of the long-stroke crankshaft operating with the rod of the piston of the larger cylinder.

According to the invention, in the case of an engine provided with spark ignition means, the engine comprises at least one spark plug in the clearance space, the ignition being achieved through means known in the art, in synchronism, at half speed, with the long-stroke crankshaft.

According to the invention, in the case of an engine provided with compression ignition means, the engine comprises at least one fuel injector in the clearance space, the fuel being injected in mesh, at half speed, with the long-stroke crankshaft.

According to the invention, engine timing is achieved through at least one camshaft in mesh, at half speed, with the long-stroke crankshaft, so as to connect periodically the pair of cylinders with the intake and exhaust pipes (not shown) via the intake and exhaust valves (not shown) at definite moments of the four-stroke cycle. The expansion phase is effected simultaneously on each piston of the paired cylinders, so as to cause the two crankshafts to co-operate with the motive force. The two crankshafts are directly linked to the engine's external transmission organs, in such a way that the variably timed transmission transmits only the engine torque of the short-stroke crankshaft on the flywheel of the engine, without passing onto the crank(s) of the large crankshaft. The effect of the different angular gaps of the variably timed transmission is during the final compression phase—(top dead centre of the piston with the largest displacement) to modify an additional space created in the smallest displacement—this additional space being defined by the clearance space, in such a way as to modify the compression ratio of the engine towards the maximal value at the start of the variably timed transmission stroke, and towards the minimal value at the end of the variably timed transmission stroke.

According to the present invention, a hydraulic force amplifier having a controlled thrustor acting on the variably timed transmission alters the additional volume of the smaller cylinder displacement in proportion to the supercharging pressure, so as to maintain the engine under optimal running conditions with a minimum of pollution.

Also according to the invention, a programme pre-established on a prototype engine permits the elimination of excessive pressure and temperature stresses. Each running condition of the engine is stored in a point-progression scale, so as to encompass all the engine output capabilities. Each storage point is a combination of values measured by four sensors: the intake air pressure, the intake air temperature, the engine speed and the engine temperature. Each combination is recorded simultaneously with the position of the thrustor actuating the variably timed transmission. This programme permits the automatic control of the standard type engine in the same way as that of the prototype engine on the test bed. The fuel quality specifications should also be identical, so that the same running conditions are reproduced exactly on the standard type engine, by means of a high frequency monitoring of the values measured by the four sensors.

According to the invention, a layout for the variably timed transmission is provided in order to improve the control device of the phase angle between a first and a second crankshaft. This arrangement is defined by a new form of spacing between the two crankshafts, in such a way as to cause projection of the variably timed transmission next to the engine flywheel. The variably timed transmission is provided with a directly-connected guidance cylinder to monitor the phase angle between the short-stroke crankshaft and the long-stroke crankshaft.

In accordance with the present invention, the dimensional relationship between the two displacements can be, as a minimum, between 1/10 and 9/10, preferably between 1/5 and 3/5, depending on the maximum degree of supercharging pressure scheduled for the engine. The configuration of the variable compression ratio engine has the axes of the two paired cylinders laid out in the form of an asymmetric inverted V in relation to the cylinder head plane. The angle of aperture between the axes of the two paired cylinders can be adapted between 1 and 60 degrees as a minimum, depending on the requirements arising from the bulk of the fixed and mobile components in the couplings of the two crankshafts.

According to the present invention, there are two different options for the arrangement of the axes of the two paired cylinders in the engine's cylinder housing: the first option for the engine sees two paired cylinders orientated in the form of asymmetric inverted V's, but with only the axis of the larger of the two cylinders fixed perpendicularly to the cylinder head plane. The piston of the small cylinder is provided with a boss which rectifies the contour of the combustion chamber in such a way as to create (at the top dead centre, in the final compression phase) the minimum form and volume of the combustion chamber; a hollow has also been provided on the piston of the large cylinder, orientated perpendicularly to the cylinder head plane. The hollow and the boss of the said pistons are advantageously created in such a way as not to obstruct the communication orifice of the two paired cylinders when the said pistons are positioned at the top dead centre.

As part of the above-mentioned first option, the omission of any boss on one of the pistons, when a compensatory recess is provided in the cylinder head, in the same form and of the same size as the projection of the said piston.

The second option for the engine has the axes of the two paired cylinders in the form of asymmetric inverted V's, but not positioned perpendicularly to the cylinder head plane. At the top of the pistons, a truncated ridge is provided for with an amount of tolerance parallel to the cylinder head plane when the said pistons are located at the top dead centre. The space comprised between the non-truncated planes of the two pistons located at the top dead centre and the cylinder head plane forms the combustion chamber.

According to the invention, depending on the two above-mentioned options, and depending on the number of pairs of cylinders orientated in an asymmetrical inverted V shape, the long-stroke crankshaft cylinder and the short-stroke crankshaft cylinder are joined to one another by their top dead centres, in such a way as to create a combustion chamber common to these two paired cylinders, the combustion chamber being linked to the said cylinders by a recess or some other channel at the level of the joint, up to the cylinder head plane, in such a way that the intake and combustion gases can continuously communicate between the said cylinders and the combustion chamber, whatever the position of the pistons is in the four-stroke cycle.

The engine flywheel is orientated around, and fastened to, the end of the long-stroke crankshaft at the rear of the engine; the engine's variably timed transmission is orientated around the end of the shaft, on the engine's flywheel side. The coupling between the small crankshaft and the engine's flywheel is joined in one piece with the said flywheel via the variably timed transmission, making it possible for the said engine's flywheel to regularise simultaneously the torque levels of each of the two crankshafts, independently of one another.

According to the present invention, depending on the two above-mentioned options, the engine's architecture is implemented on the basis of the requirements laid down by the separation distance between the two crankshafts. At the lesser separation distance between the two gears orientated around their respective crankshafts, the latter are directly coupled at the same rotation speed. At the greater separation distance between the two crankshafts, a kinematic chain, comprising two complementary coupling gears orientated around their respective crankshafts, is provided for, which also brings about a coupling at the same rotation speed.

According to the invention, depending on the two above-mentioned options, the control cylinder method is just as valid when the variably timed transmission is located at the front of the engine, in such a way as to be able to vary the angular timing between the two crankshafts without going through the intermediary of the flywheel located at the rear of the engine.

The invention will now be described in greater detail with the help of the following description and with reference to 7 appended drawings and a diagram, showing two specific embodiments illustrated by way of example only, representing two engine options.

BRIEF DESCRIPTION OF THE DRAWINGS

FIG. 8 is a diagram which discloses possible combinations for designing the construction of the variable compression ratio engine.

DESCRIPTION OF PREFERRED EMBODIMENTS

Figure 1:
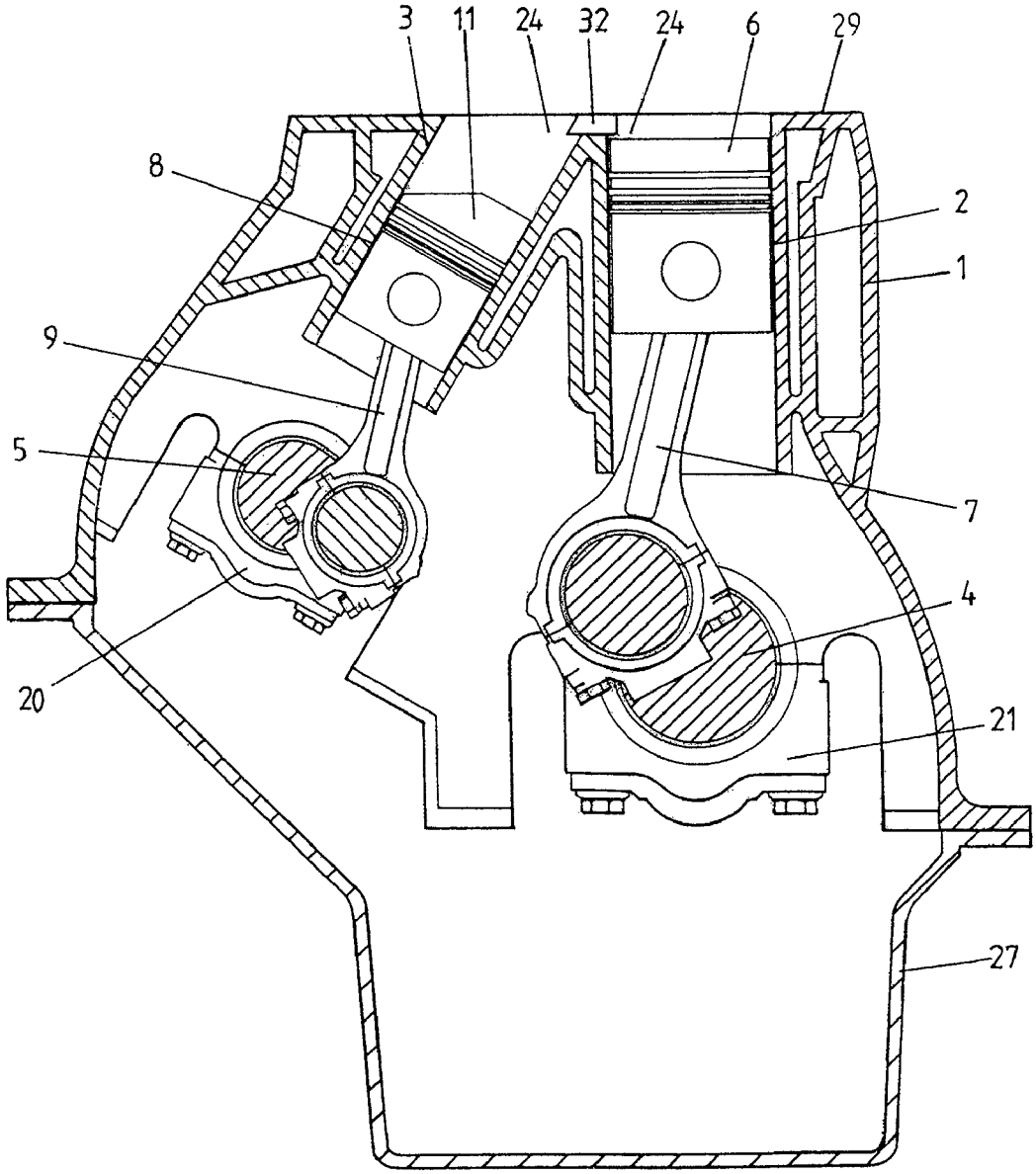
FIG. 1 shows a cross-section view of the cylinder housing (1) of an engine, without the cylinder head part.

FIG. 1 shows a cross-section view of the cylinder housing (1) of an engine. To make the drawing clearer, the counterweights (28) are not shown on the crankshafts (4,5). The two paired cylinders (2,3) are orientated in the form of asymmetrical inverted V's, and with the axis of the larger of the two cylinders (2) being located perpendicularly to the cylinder head plane (29). The combustion chamber (24) which is common to these two paired cylinders (2,3) is located in the cylinder housing (1). In the combustion chamber (24) is an orifice (32). A hollow is also provided (not shown) on the piston (6) of the cylinder (2) positioned perpendicularly to the cylinder head plane. A boss (11) is provided for on the piston (8) of the cylinder (3). The pistons (6,8) are positioned in the expansion phase to demonstrate the intervals between the two couplings of the crankshafts (4,5). The axial aperture of the two paired cylinders (2,3) laid out like asymmetrical inverted V's is defined as 30 degrees. The axis, A, of the large cylinders, 2, is perpendicular to the cylinder head gasket, 29. The passage or channel (32) is formed in the housing and extends, for each pair of cylinders (2,3), between a small cylinder and a large cylinder.

Figure 2:
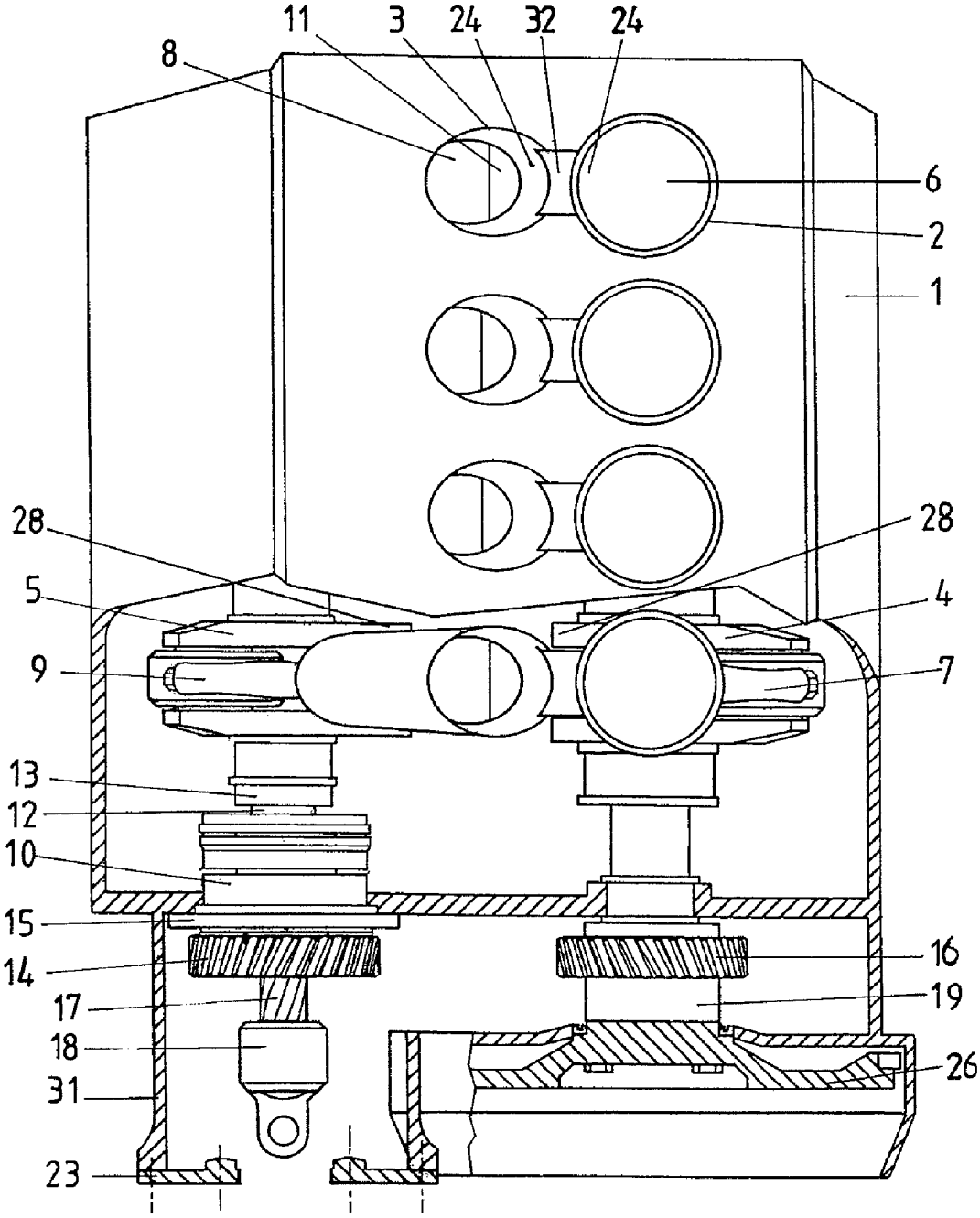
FIG. 2 represents a plan view of the cylinder housing of FIG. 1.

FIG. 2 represents a plan view of the cylinder housing of FIG. 1. The 4 pairs of two cylinders can be seen in perspective. The partial section or partially exploded view makes it possible to see the variably timed transmission (10) as well as the gears (14,16) of the two crankshafts (4,5) without the two intermediate link gears (not shown). The pistons are shown in the exhaust phase in order to demonstrate the space required between the couplings of the two crankshafts (4,5) and the side walls of the cylinder housing. The variably timed transmission (10) and the engine's flywheel (26) can be disengaged on the basis of the angular aperture of the two paired cylinders (2,3) orientated in the form of asymmetrical inverted V's, positioned at 30 degrees. The channel (32) has an average width (width measured perpendicularly to the straight line passing through the point of intersection of the axis of the large cylinder with the cylinder head gasket plane) lying between 0.5 and 0.8 times the average of the diameters of the cylinders. The average width is advantageously determined on the level of the cylinder head gasket plane. Preferably, the minimal width of the channel, at the level of the cylinder head gasket plane (29) is advantageously between 0.3 times and 1 time (in particular between 0.5 and 0.8 times) the average of the diameters of the cylinders of a group. The volume of a channel lies between 2% and 15% of the minimal clearance volume with the two pistons at top dead centre.

Figure 3:
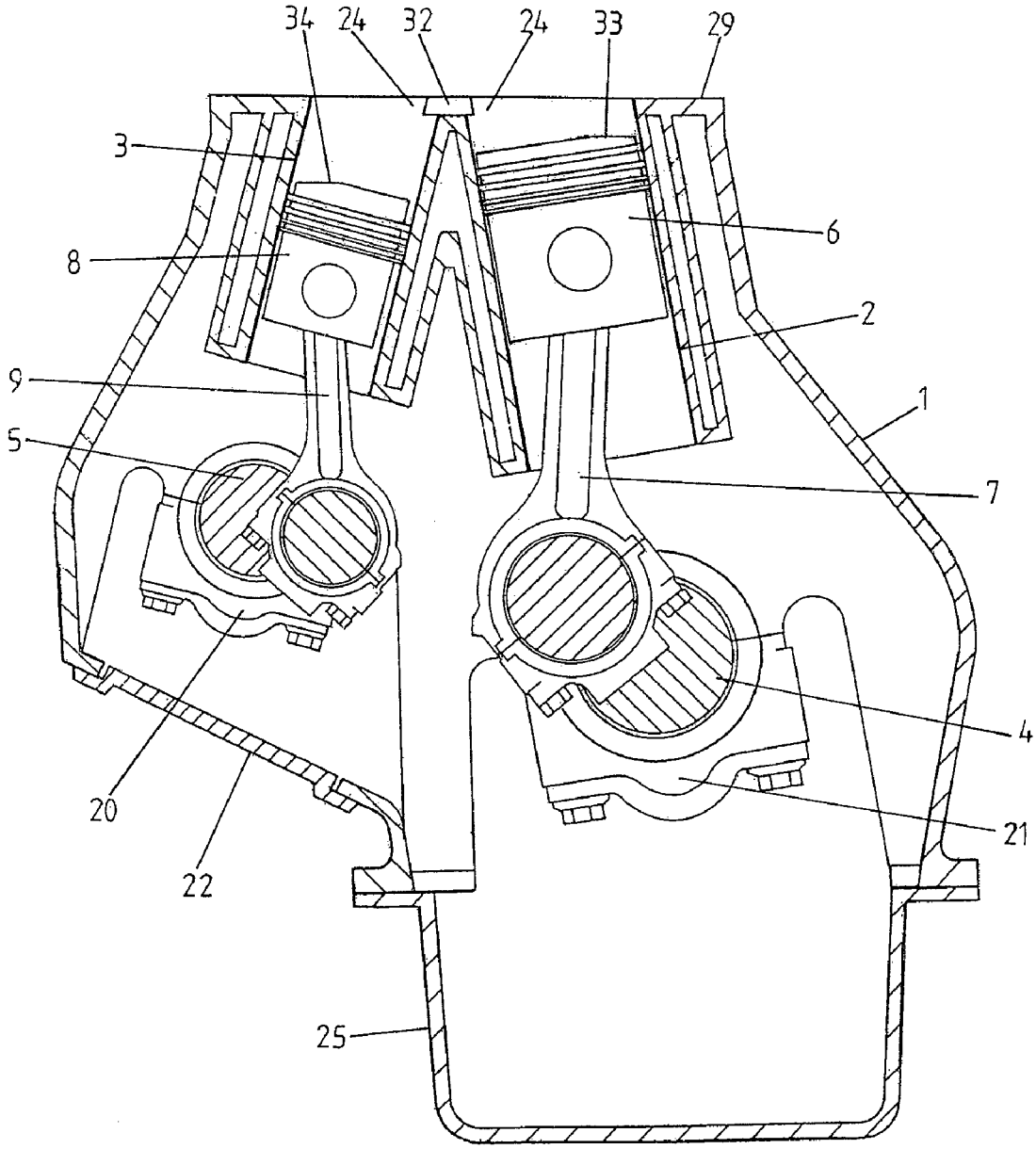
FIG. 3 represents a cross-section view of the cylinder housing (1) of FIG. 1.

FIG. 3 represents a cross-section view of the cylinder housing (1). To make the illustration clearer, the counterweights (28) are not shown on the crankshafts (4,5). The two paired cylinders (2,3) can be distinguished, orientated asymmetrically in the form of inverted V's, with the axes of these cylinders not being located perpendicularly to the cylinder head plane (29). The combustion chamber (24) common to these two paired cylinders (2,3) is located in the cylinder housing (1) with a truncated ridge at the top of each of these pistons (6, 8), delimited by the cylinder head plane (29). In the combustion chamber (24) an orifice (32) is included. The pistons have been shown in the expansion phase in order to demonstrate the space necessary between the couplings of the two crankshafts (4,5). The axial aperture of the two paired cylinders (2,3), formed as an asymmetrical inverted V, has been defined on an angular aperture of 24 degrees, split between 9 degrees for the large cylinder and 15 degrees for the small cylinder in relation to the cylinder head plane (29). Disengagement between the variably timed transmission (10) and the engine's flywheel (26) can be implemented on the basis of the angular aperture of the two paired cylinders (2,3), orientated in the form of asymmetrical inverted V's, located at 24 degrees.

Figure 4:
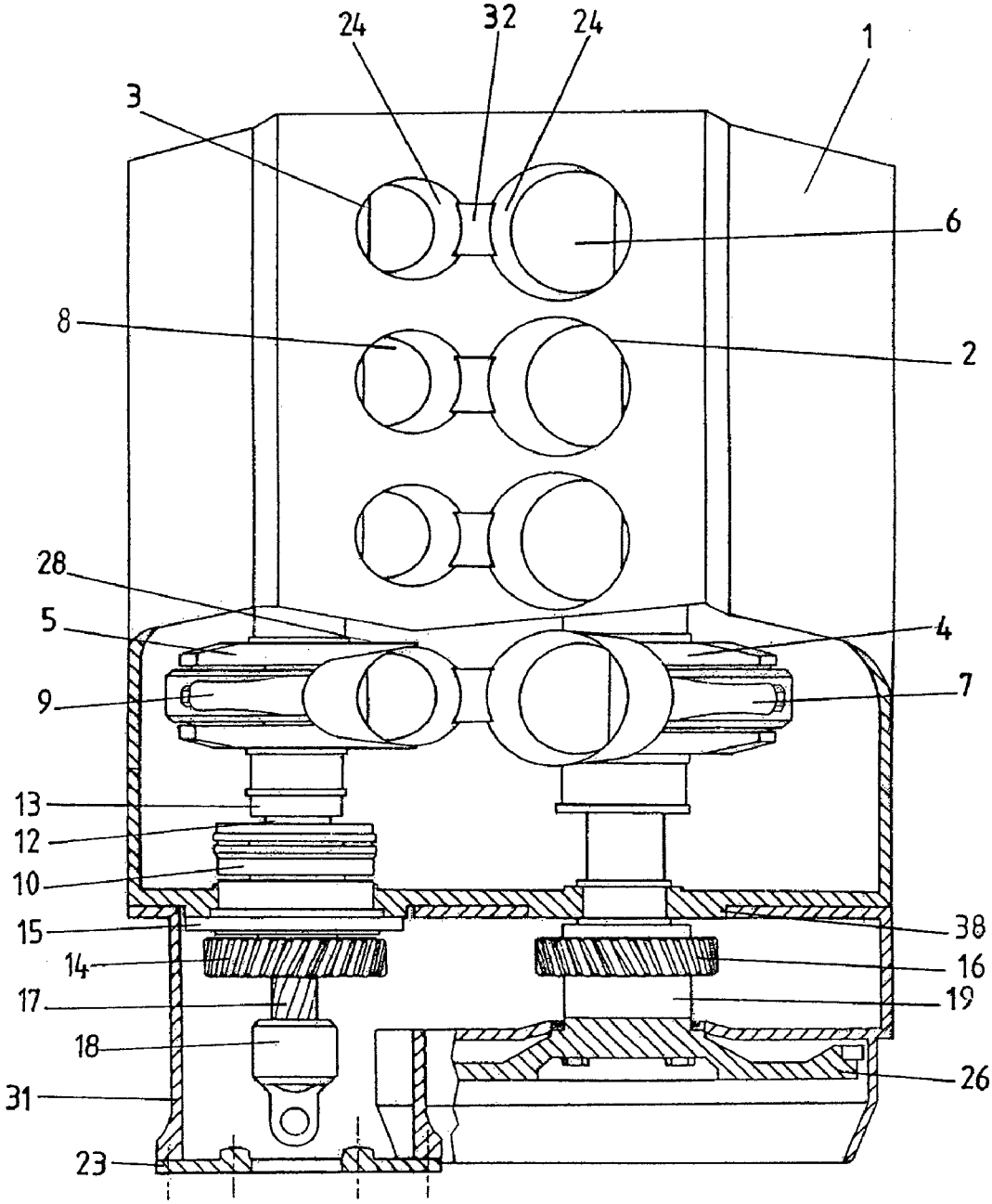
FIG. 4 represents a plan view of the cylinder housing of FIG. 3.

FIG. 4 represents a plan view of the cylinder housing of FIG. 3. The four pairs of two cylinders (2,3) can be seen in perspective. The partially exploded view makes it possible to see the variably timed transmission (10) as well as the gears (14,16) of the two crankshafts (4,5) without the two intermediate gears (not shown). The pistons (6,8) are positioned in the exhaust phase to represent the intervals between the two couplings of the crankshafts (4,5) and the side walls of the cylinder housing (1). Disengagement between the variably timed transmission (10) and the engine's flywheel (26) can be implemented on the basis of the angular aperture of the two paired cylinders (2,3) orientated in the form of asymmetrical inverted V's located at 24 degrees. The axes of the cylinders (2,3) are not perpendicular to the cylinder head gasket plane. In relation to a straight line perpendicular to the cylinder head plane, the axis of the large cylinder (2) is advantageously less inclined than the axis of the small cylinder, (3).

Figure 5:
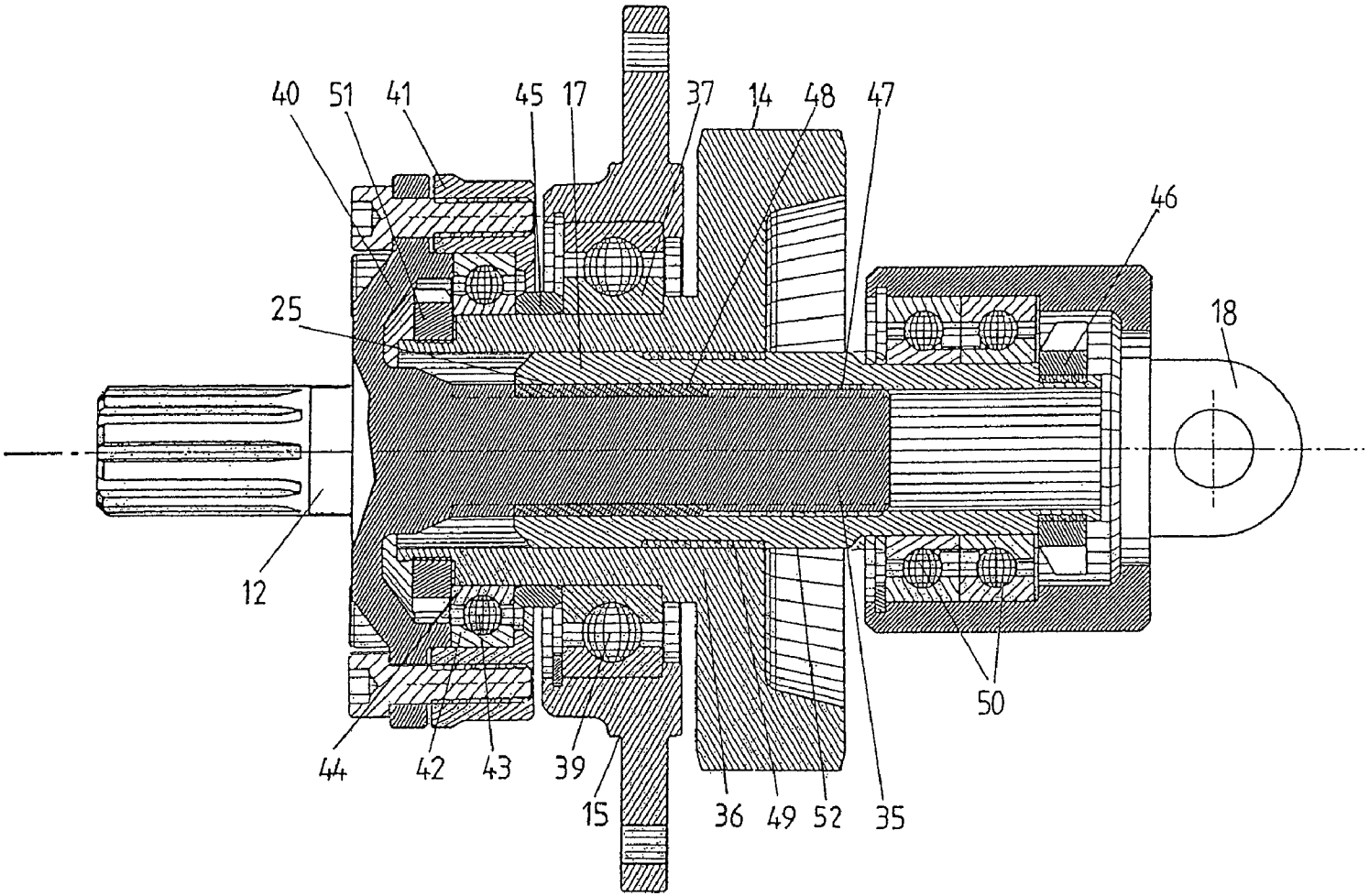
FIG. 5 represents a section view parallel to the axis of the variably timed transmission of the engine of FIG. 1.

FIG. 5 represents a section view parallel to the axis of the variably timed transmission. At the end of the shaft (12), the external splines of the variably timed transmission can be seen.

Figure 6:
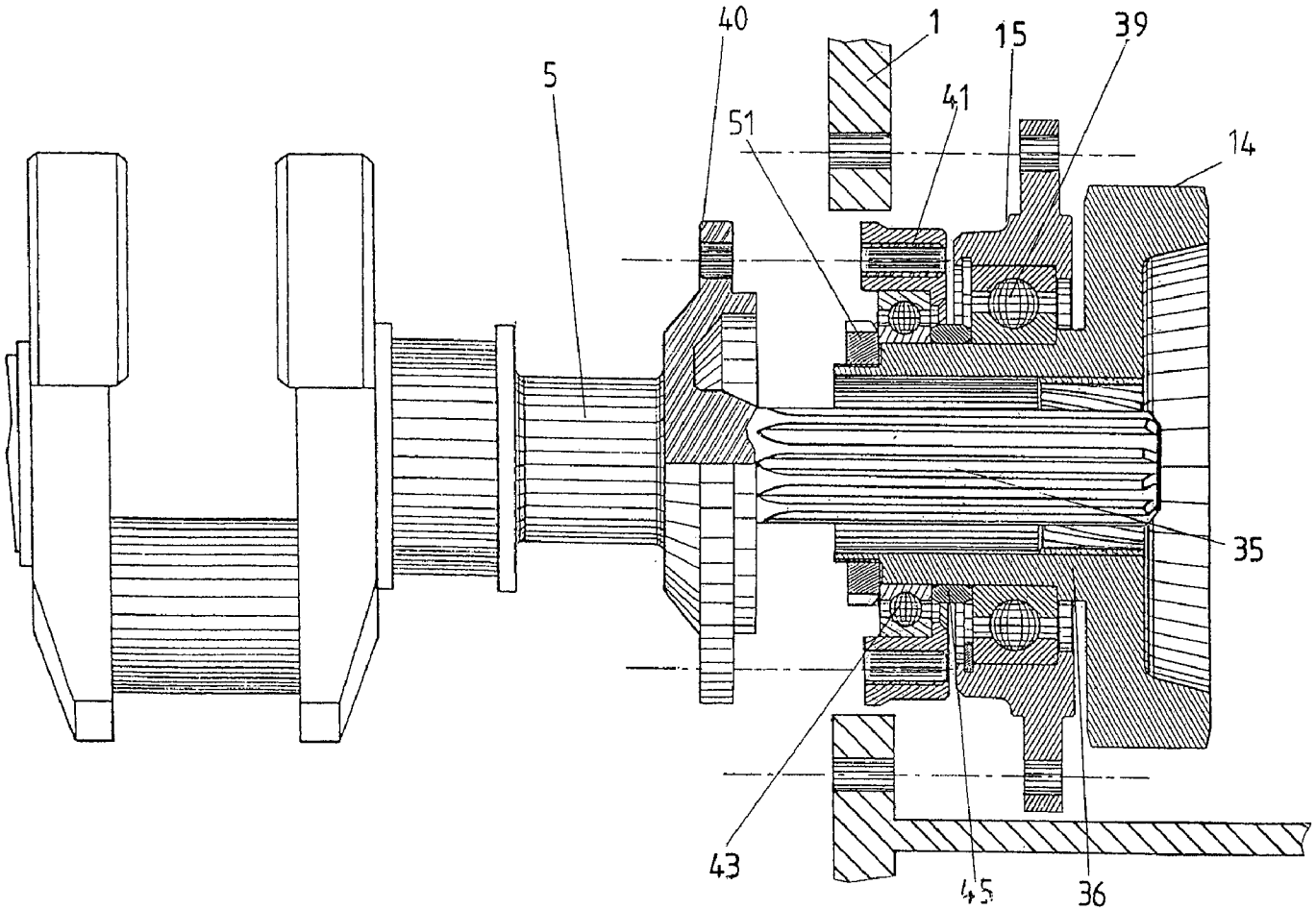
FIG. 6 represents a partial section view of the variably timed transmission, the coupling shaft (12) of which is integrated with the shaft of the small-stroke crankshaft (5)

FIG. 6 represents a partial section view of the variably timed transmission, the coupling shaft (12) of which is integrated with the shaft of the small-stroke crankshaft (5).

Figure 7:
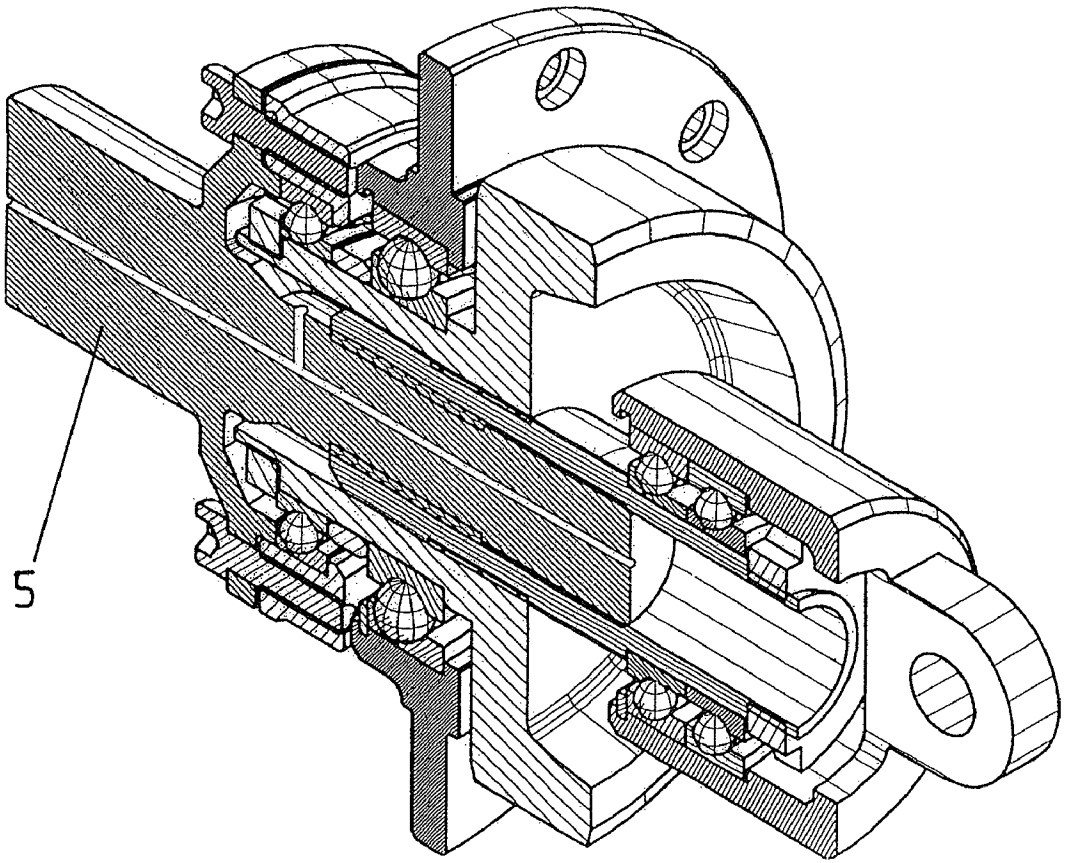
FIG. 7 is a perspective section view of the variably timed transmission integrated with the shaft of the small-stroke crankshaft, in which the lubrication channels can be detected.

FIG. 7 is a perspective section view of the variably timed transmission integrated with the shaft of the small-stroke crankshaft, in which the lubrication channels can be detected.

FIGS. 8A and 8B are diagrams disclosing 32 possible combinations for designing the construction of the variable compression ratio engine.

In said FIGS. 8A and 8B, the following references are used:

A: Engine in the form of inverted V with the large cylinders perpendicular to the cylinder head plane;

A1: Pistons of the Small Cylinders are provided with a boss;

A2: Pistons of the Small Cylinders travel in the hollows provided in the Cylinder heads;

B: Engine in the form of inverted V with the cylinders not perpendicular to the cylinder head plane;

B1: Engine with Truncated pistons;

B2: Engine where the pistons travel in a hollow in the cylinder head;

A3, B3: Coupling housing cannot be separated from the cylinder housing;

A4, B4: Coupling housing can be separated from the cylinder housing;

A5, B5: The variably timed transmission can be separated from the small-stroke crankshaft;

A6, B6: The variably timed transmission cannot be separated from the small-stroke crankshaft;

A7, B7: Oil sump enclosing the two crankshafts entirely;

A8, B8: Oil sump enclosing only the large-stroke crankshaft.

It can be seen from FIGS. 1 to 7 that the cylinder housing (1) includes two crankshafts (4,5) laid out in parallel, one with a long-stroke crank (4), the other with a short-stroke crank (5). The two cylinders (2,3) fitted respectively with pistons (6,8) and respectively with levers (7,9) are each positioned above the two crankshafts (4,5). The crank of the short-stroke crankshaft (5) supported by the bearing housings (20) operates with the rod (9) of the piston (8) of the smaller cylinder (3), the crank of the long-stroke crankshaft (4) supported by the bearing housings (21) operating with the rod (7) of the piston (6) of the larger cylinder (2). The axes of the two paired cylinders (2,3) are positioned in the cylinder housing (1) in the form of an asymmetrical inverted V in relation to the cylinder head plane (29). It can be observed that the two above-mentioned small cylinders are also joined to one another by means of a clearance space relative to the common combustion chamber (24). The passage of the gases between the said cylinders (2,3) is brought about by an orifice or internal channel, or a channel formed in the cylinder housing (32) of the said combustion chamber.

The relationship between the capacities of the two paired cylinders (2, 3) on the four diagrams is fixed at 2/5, which determines a part of the theoretical torque of 2/7 for the displacement of the small cylinder (3) in relation to the total displacement of the two paired cylinders (2,3). The centre distance (head to foot) of the rods in relation to the stroke of the pistons is fixed at 1.68. The stroke/bore ratio of the cylinders is fixed at 1.21.

The dimensioning of the other organs of the two options for engines has been laid down on the basis of a type of compression ignition engine widely tested with 6 cylinders in line, at a maximum speed of 2,200 r.p.m. and at 400 horse power, and validated over a journey of 1,500,000 kilometres.

In the compression ignition version, the engine includes at least one fuel injector (not shown) in the clearance space (24). The fuel injection is carried out using known methods (not shown) connected at half-speed with the long-stroke crankshaft (4).

In the controlled ignition version, the engine includes at least one sparking plug (not shown) in the clearance space (24). The ignition is effected by known methods (not shown) and synchronised, at half-speed, with the long-stroke crankshaft (4).

For engines with a very large displacement, a second camshaft (not shown) connected at half-speed with the long-stroke crankshaft (4) can be provided for in the part of the cylinder head (not shown) overhanging the smaller cylinder (3), in such a way as to provide for periodic second openings and closings of the intake and exhaust at the same moment as the opening and closing of the four-stroke cycle carried out in the larger cylinder (2). The ratio between the displacements of the two paired cylinders (2,3) lies at least between 1/10 and 9/10, and preferably between 1/5 and 3/5, making it possible to adapt the engine to supercharging pressure rates of 1 to 7.

The variably timed transmission (10) is made up of three superimposed concentric elements: the first element is made up of the transmission shaft (35) located in the internal part, the second element is made up of the sleeve (36) of the gear (14) located in the external part and the third element is made up of the sliding tube (17) located in the intermediate part between the two other elements mentioned above. The said sleeve (36) is maintained in a bearing plate (15) by means of a bearing (39) with an appropriate row between the bearing plate (15) and the sleeve (36). The said bearing plate (15) is fastened to the cylinder housing (1) in such a way that the variably timed transmission (10) can constitute an assembly separated from the shaft (13) of the short-stroke crankshaft (5). To this end, the short-stroke crankshaft (5) and the variably timed transmission (10) are mounted connected with their respective shafts (12) and (13). The variably timed transmission (10) is equipped with a bearing plate (15) which is fastened by centring in an orifice provided for in the cylinder housing (1). The straight internal splines of the shaft (12) located in the journal of the bearing housing (20) are mated with the external straight splines of the shaft (13), in order to provide a sufficient level of rigidity for the axis of the variably timed transmission and a reduced space requirement for the coupling between the two shafts (12) and (13); this layout making it possible to remove the variably timed transmission from the engine block (1) without having to go on to remove the short-stroke crankshaft (5).

The substitution of a coupling with support by the bearing housing (20) of the journal of the short-stroke crankshaft (5) for a coupling without support between the short-stroke crankshaft (5) and the variably timed transmission (10) gives the advantage of limiting the bearing (39) to a single appropriate row between the bearing plate (15) and the sleeve (36).

Drive shaft (35) and sleeve (36) are advantageously held concentrically and axially with respect to each other by means of a bearing housing (40) rigidly connected to shaft (35). The bearing housing (40) is provided with an axial and radial thrust bearing (43), so as to permit free rotation of shaft (35) independently of sleeve (36). The bearing housing (40) constitutes an integral part of the shaft (35) at the point where the boundary of the straight splines (12) and (47) is located. The bearing housing (40) and sleeve (36) are located inside the engine unit (1). The bearing housing (40) is manufactured in the form of a disc, regularly pierced with holes, so as to permit a ring (41) to be bolted onto the surface on the side on which the boundary of the straight splines (47) of the shaft (35) is located. The mounting of ring (41) on the flywheel of the bearing housing (40) serves to form a recess, so as to permit the mounting of the outer ring (42) of the axial and radial thrust bearing (43). The inner ring (44) of bearing (43) is mounted on the sleeve (36) against a ring-shaped spacer (45) encircling sleeve (36). The spacer (45) serves to take up the space between the inner ring (44) of bearing (43) and the inner ring of the angular contact bearing (39), the latter being held axially against a shoulder of sleeve (36) through the securing of all above parts, by means of a single nut (51) on sleeve (36).

Gear (14) of sleeve (36) is located outside the engine housing (1) instead of the engine unit (1) and is coupled, at the same rotational speed, to the long-stroke crankshaft (4) by means of a gear (16) rigidly mounted on the latter and an intermediate gear (21) located between both aforesaid gears (14,16).

The drive shaft (35) comprises, on the side of the bearing housing (40) facing the bearing plate (15), straight splines (47) onto which the sliding tube (17) is engaged. This sliding tube (17) includes, on its internal periphery, some splines (48) mated to the straight splines (47), in such a way that the sliding tube (17) can slide axially on the transmission shaft (35).

The inner surface of sleeve (36) comprises helical splines (49) mated to the outer helical splines (52) of the sliding tube (17), so as to permit the latter to travel helically in sleeve (36) and provide an angular displacement between said second and third members, at the same time as the helical travel of the sliding tube (36) along drive shaft (17). The sleeve (36) is fixed interdependently, in rotation with the shaft (35), when the sliding tube (17) is not in axial translation.

The length of the sliding tube (17) is pre-determined inside the sleeve (36) when the end of the said sliding tube (17) is located at the stop limit defined by the obstruction of the bearing housing (40). The other end of the sliding tube (17) is free outside the sleeve (36), passing through the gear (14) outside the engine unit (1) to allow, using appropriate means, the fastening of the two-row oblique contact internal bearing ring (50). The said internal bearing ring (50) is made interdependent with the rotational movement of the sliding tube (17), whereas the external bearing ring (50), without any rotational movement, is made interdependent with the holding member (18).

A decision-making memory of the compression ratio programme, acting by means of a hydraulic control system, permits the holding member (18) and the sliding tube (17) to be shifted, so as to alter the lead angle between the two crankshafts (4,5).

The start-of-travel of the variably timed transmission is arranged so that the sliding tube (17) is at the exit stop position provided for on the cylinder (not shown) corresponding to the minimum angular feed of the crank of the short-stroke crankshaft (5) and the crank of the long-stroke crankshaft (4).

The end-of-travel of the variably timed transmission is arranged so that the sliding tube (17) is at the stop position (also provided for on the cylinder but not shown) corresponding to the maximum angular feed of the crank of the short-stroke crankshaft (5) and the crank of the long-stroke crankshaft (4).

Engine timing is achieved by means of at least one camshaft (not shown) in mesh, at half speed, with the long-stroke crankshaft (4). The intake and exhaust valves (not shown), which connect periodically the pair of cylinders (2,3) with the intake and exhaust pipes (not shown) at definite moments of the four-stroke process.

The ratio between the displacement of the cylinder (3) and the displacement of the cylinder (2) is at least between 1/10 and 9/10, preferably between 1/5 and 3/5, making it possible to adapt the compression ratio of the engine on the basis of the supercharging pressure.

The variably timed transmission (10) is equipped with a bearing plate (15) which is fastened to the cylinder housing (1), in such a way that the variably timed transmission (10) can constitute a separate assembly from the shaft (13) of the short-stroke crankshaft (5). To this end, the variably timed transmission (10) and the short-stroke crankshaft (5) are each manufactured with their respective shaft (12,13). The external splines end of the shaft (12) of the variably timed transmission (10) is manufactured in such a way as to make the internal splines located in the bearing housing (20) journal and in the shaft (13) correspond. The coupling between the two abutting parts is provided for by axial sliding at the moment of application of the bearing plate (15) into an orifice provided for in the cylinder housing (1). The bearing plate (15) is orientated around the shaft (13) of the short-stroke crankshaft (5), in such a way as to allow the centring of the shaft (12) in the journal (20) and in the said shaft (13), the latter advantageously serving as a rigid bearing housing for the shaft (12) when the bearing plate (15) is applied to the cylinder housing (1); this method making it possible to remove the variably timed transmission (10) from the coupling housing (1) without having to proceed to remove the short-stroke crankshaft. The abutting male end of the shaft (12) of the variably timed transmission (10) and the abutting female end fashioned in the shaft (13) at the level of the journal (20) of the short-stroke crankshaft (5) confer the advantage of reducing the bulk of the coupling of the variably timed transmission in the engine housing (1).

According to a preferred form of the invention, the engine includes means of reinforcing the axial rigidity between the short-stroke crankshaft (5) and the variably timed transmission (10). The shafts (12,13) are merged into a single shaft in such a way as to allow the transmission shaft (35) comprising the disc (40) and the straight splines (47) to be associated with the short-stroke crankshaft (5). The separation distance between the fastening supports of the disc (40) and the bearing plate (15) is made to equal the separation distance between the fastening of the cylinder housing (1) of the bearing plate (15) and the fastening support of the disc (40) when the short-stroke crankshaft is inserted into the bearing housings (20) of the cylinder housing (1). This assembly means that there is an axial fastening of the shaft of the short-stroke crankshaft (5) by the bearing (39) and an axial fastening of the sleeve (36) by the bearing housings of the short-stroke crankshaft (5).

According to a preferred form of the invention, in the coupling housing (31) there is provision for two intermediate coupling gears (not shown) between the gears (14) of the short-stroke crankshaft (5) and a second gear (16) fastened to the spacer (19) interdependently with the engine's flywheel (26) and the long-stroke crankshaft (4), in such a way as to obtain inverted directions of rotation (at the same speed) for the two crankshafts (4,5).

The variably timed transmission (10) includes a sliding tube (17) on the side facing the gear (14), the external part of the sliding tube having on its periphery helical splines (52) mated to the helical splines (49) of the gear (14). The sliding tube (17) also includes straight internal splines (47) mated to the external splines (48) interdependently with the shaft (12), onto which the sliding tube (17) is engaged, in such a way that, in sliding, the said tube (17) can bring about the angular gap between the transmission shaft (12) and the gear (14).

A memory of the program's decision on the compression rates acts on the control cylinder (not shown) fastened to the holding member (18) and the sliding tube (17) in order to modify the angular gap between the two shafts of the two crankshafts (4,5).

The start-of-travel and the end-of-travel of the variably timed transmission can be handled in such a way that the sliding tube (17) can not slide beyond the stop positions which are provided for on the control cylinder (not shown). The said control cylinder is fastened on a support provided for on the closing cover (23) of the coupling housing (31) positioned next to the engine's flywheel (26). Removing the closing cover (23) makes it possible to have access for maintenance or for the removal of the variably timed transmission (10) without the removal of the coupling housing (31). According to the invention and according to this layout, the axis of the said control cylinder is advantageously fastened to the holding member (18) of the control of the variably timed transmission (10).

According to a preferred form of the invention, the minimum and maximum compression ratios selected for the type of engine to be designed are determined based on the dimensions of the different engine members, i.e. on the one hand, the ratio between the displacements of the paired cylinders (2 and 3) and, on the other hand, the ratio between the total displacement of these cylinders (2 and 3) and the clearance space (24), these ratios being defined so that the maximum lead angle between the crank of the short-stroke crankshaft (5) and the crank of the long-stroke crankshaft (4), defined by the end-of-travel position of the variably timed transmission, determines at the end of the compression phase (top dead centre of piston 6), the position of piston (8) with respect to the additional volume required for the clearance space (24) to define said minimum compression ratio of the engine, with an angle of at least 90° between the connecting rod (9) and the crank of the short-stroke crankshaft (5).

The adjustment of the angle between both crankshafts, in the end-of-travel position of the variably timed transmission, in function of the appropriate dimensions of the different engine members, allow the engine to operate:

- in the expansion phase, with the combustion gases on the piston (8) associated at least from the maximum instantaneous torque on the crank of the short-stroke crankshaft (5);
- in the expansion phase, by limiting the rise of piston (8) prior to the opening of the exhaust valve (not shown), a source of combustion gas back pressure on said piston (8);
- at the end of the intake phase, by limiting the rise of piston (8), a cause of loss of filling volume within the cylinder (3).

This offers the advantage of maintaining the maximum specific output of the engine at full load.

The maximum compression ratio selected is achieved with the same data basis of dimensional values defined for the minimum compression ratio so that the minimum lead angle between the crank of the short-stroke crankshaft (5) and the crank of the long-stroke crankshaft (4), defined by the start-of-travel position of the variably timed transmission, determines at the end of the compression phase (top dead centre of piston 6), the position of piston (8) with respect to the additional volume required for the clearance space (24) to define said maximum compression ratio of the engine, with the connecting rod (9) of the crank of the short-stroke crankshaft (5) away from its top dead centre, so that said connecting rod (9) forms an angle with the crank of the short-stroke crankshaft (5).

The adjustment of the angle between both crankshafts (4,5), in the start-of-travel position of the variably timed transmission, in function of the appropriate dimensions of the different engine members, allows the engine to operate:

- at the end of the compression phase, by providing a greater translational motion to piston (8) per unit degree of angular displacement between the cranks of the two crankshafts (4,5).

This offers the advantage of speeding up the modification process of the compression ratio of the engine at low load.

Explanation of Symbols Used:

p=compression ratio

V1=displacement of the larger cylinder of the paired cylinders.

V2=displacement of the smaller cylinder of the paired cylinders.

V1/V2=ratio between the displacements on the paired cylinders

α=lead angle of the crank of the short-stroke crankshaft ve=clearance space of the paired cylinders required for gas transfer without excessive lamination.

(α minimum)=lead angle of the crank of the short-stroke crankshaft, at the start-of-travel of the variably timed transmission.

(α maximum)=lead angle of the crank of the short-stroke crankshaft, at the end-of-travel of the variably timed transmission.

Va(α minimum)=additional volume added to the clearance space, at the start-of-travel of the variably timed transmission, defined by the minimum lead angle of the crank of the short-stroke crankshaft.

Va(α maximum)=additional volume added to the clearance space, at the end-of-travel of the variably timed transmission, defined by the maximum lead angle of the crank of the short-stroke crankshaft, when the crank of the long-stroke crankshaft is located at its top dead centre, at the end of the compression phase.

Vr(α minimum)=compressed air volume at the start-of-travel of the variably timed transmission, defined by the minimum lead angle of the crank of the short-stroke crankshaft, when the crank of the long-stroke crankshaft is located at its bottom dead centre, at the end of the intake phase.

Vr(α maximum)=compressed air volume at the end-of-travel of the variably timed transmission, defined by the maximum lead angle of the crank of the short-stroke crankshaft, when the crank of the long-stroke crankshaft is located at its bottom dead centre, at the end of the intake phase.

Compression ratio characteristics and formulas of the variable volume combustion chamber engine.

$(V1+V2)\times$number of pairs of cylinders=engine displacement.

$V1+[V2-Vr(\alpha)]\times$number of pairs of cylinders=displacement of the engine defined by the lead angle of the variably timed transmission.

$$\frac{V1+[V2-Vr(\alpha)]+ve}{ve+Va(\alpha)}=P.\text{theoretic}$$

theoretical compression characteristic of the engine after definition of the compression ratios established by the lead angle of the variably timed transmission.

$$\frac{V1+[V2-Vr(\alpha\text{minimum})]+ve}{ve+Va(\alpha\text{minimum})}=P\text{ maximum}$$

Definition of the maximum compression ratio at the start-of-travel of the variably timed transmission. In practice, Vr(α minimum) should not be deducted from V2 as it is too negligible.

$$\frac{V1+[V2-Vr(\alpha\text{maximum})]+ve}{ve+Va(\alpha\text{maximum})}=P\text{ minimum}$$

Definition of the minimum compression ratio at the end-of-travel of the variably timed transmission. In practice, Vr(α maximum) should not be deducted from V2 since the air mass admitted in V1 and V2 depends on the stored calibration at the maximum supercharging pressure.

A simplified formula of the compression ratio may be assumed depending on whether Va(α) is located at any angular position between the start-of-travel and the end-of-travel of the variably timed transmission, which is:

$$\frac{V1+V2+ve}{ve+Va\ (\alpha)}=P$$

According to the invention, the minimum compression ratio selected may be achieved between two end-of-travel limits of the variably timed transmission. The first limit is achieved with a maximum lead angle between the crank of the short-stroke crankshaft (5) and the crank of the long-stroke crankshaft (4), so as to determine at the end of the compression phase (top dead centre of piston (6) the position of piston (8) with respect to the additional volume required for the clearance space (24) to define said minimum compression ratio with an angle of at least 90° between the connecting rod and the crank of the short-stroke crankshaft (5), the second limit is achieved with a smaller lead angle between the crank of the short-stroke crankshaft (5) and the crank of the long-stroke crankshaft (4), proportionally to the reduction of the displacement ratio of the two cylinders (2 and 3), up to the tolerance limit generated by the working area of the two crankshafts (4 and 5), defined by the parallel and close positions of the paired cylinders (2 and 3), according to the following minimum compression ratio formula $$\frac{V1+[V2-Vr(\alpha\text{maximum})]+ve}{ve+Va(\alpha\text{maximum})}=P\text{ minimum}$$

It is possible to define a higher compression ratio between the displacements of the paired cylinders, so as to reduce the stresses on the variably timed transmission mounted on engines having lower displacements and inversely, it is possible to define a smaller compression ratio between the displacements of the paired cylinders (2 and 3), so as to increase the speed of engines having higher displacements.

In practice, Vr(α maximum) should not be deducted from V2, since the mass of air admitted in V1 and V2 depends on the stored calibration between the compression ratio and the supercharging pressure.

The maximum compression ratio selected is achieved on the basis of the dimensional values defined for the minimum compression ratio, so that at the start-of-travel of the variably timed transmission, the minimum lead angle between the crank of the short-stroke crankshaft (5) and the crank of the long-stroke crankshaft (4) determines, at the end of the compression phase (top dead centre of piston 6), the position of piston (8) with respect to the additional volume required for the clearance space (24) to define a maximum compression ratio, with the connecting rod (9) of the crank of the short-stroke crankshaft (5) away from its top dead centre, so that said connecting rod (9) forms an angle with the crank of the short-stroke crankshaft (5). The maximum compression ratio may thus be defined by means of the following formula:

$$\frac{V1 + [V2 - Vr(\alpha\text{minimum})] + ve}{ve + Va(\alpha\text{minimum})} = P\ \text{maximum}$$

In practice, Vr(α minimum) should not be deducted from V2, since the mass of air admitted in V1 and V2 depends on the stored calibration between the compression ratio and the atmospheric depression in the intake pipe.

Figure 10:
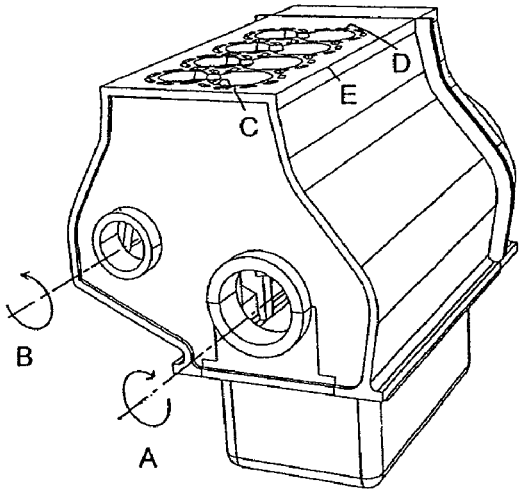
Figure 11:
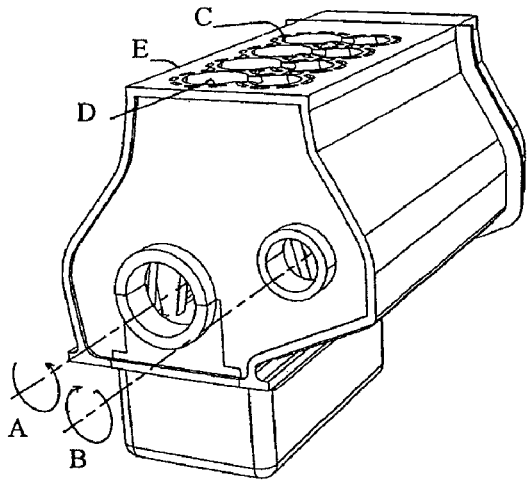

The diagrams of FIGS. 10 and 11 are based on the following formula:

a=top dead centre of smaller cylinder (3)

b=summit of smaller piston (8)

s=surface of smaller piston (8)

l=length of smaller connecting rod (9)

r=length of smaller crankshaft (5)

A=top dead centre of larger cylinder (2)

B=summit of larger piston (6)

S=surface of larger piston (6)

L=length of larger connecting rod (7)

R=length of larger crankshaft (4)

Vm=clearance space (24)

α=angular rotation (0° at top dead centre) (counterclockwise)

ϕ=lead angle of smaller crankshaft (5) with respect to the larger crankshaft (4).

$$V = ab \times s + AB \times S + Vm = s\left[r\left(1 - \cos(\alpha + \varphi) + 1\left(1 - \sqrt{1 - (r/l)^2 \sin^2(\alpha + \varphi)}\right)\right] + S\left[R(1 - \cos\alpha) + L\left(1 - \sqrt{1 - (R/L)^2 \sin^2\alpha}\right)\right] + Vm$$

Example to make the engine functional and increase performance according to one of the numerous applications:

The above formula stored in a computer computation sheet allows generation and selection of the dimensional values of the different engine members, i.e. the compression ratios between the displacements of the paired cylinders (2,3) and the ratio between the total volume of these cylinders (2,3) and the clearance space (24); the computation sheet is defined so that the values reckoned for the maximum and minimum compression ratios of the engine coincide with the corresponding degrees of the minimum and maximum lead angles between the crank of the short-stroke crankshaft and the crank of the long-stroke crankshaft, respectively at the start-of-travel and at the end-of-travel of the variably timed transmission.

Advantages for a four-stroke engine with compression ignition means.

- higher volumetric efficiency;
- higher specific output;
- lower losses due to mechanical friction;
- engine accommodation to the cetane number;
- accurate definition of an ideal temperature at the end of the compression phase, so to provide suitable self-ignition of the fuel in all circumstances (from cold starting to high supercharging pressures);
- better engine performance at high altitudes;
- lower emissions of hydrocarbons and nitrogen oxide in the exhaust gases.

Advantages for a four-stroke engine with spark ignition means.

- higher volumetric efficiency;
- higher specific output;
- lower losses due to mechanical friction and pumping;
- higher partial-load efficiency of the engine, due to a higher compression ratio proportionally to the depression in the intake pipe (closing of the throttle valve);
- engine accommodation to the octane number;
- better engine performance at high altitudes;
- better air-fuel mixture homogeneity;
- lower emissions of carbon monoxide, nitrogen oxides and hydrocarbons in the exhaust gases.

Advantages and conditions of use of the four-stroke engine with compression ignition means and high supercharging pressure levels, mounted in road haulage tractors.

The reduction of the displacement of each cylinder of the engine, based on the mean piston speed, permits an increase in the speed of the engine and a consistent decrease in low frequencies. A higher gear reduction on the gearbox—output shaft assembly should however be provided up to the second engine-drive reduction. Since the mechanical friction is proportional to the displacement and less load-sensitive, the efficiency is higher. The engine brake may be kept whilst increasing the power of the engine, supported by a speed limiter on the vehicle.

In the form shown in FIG. 6, the radial rigidity between the short-stroke crankshaft (5) and the variably timed transmission (10) is reinforced.

The shafts (12,13) are merged into a single shaft in such a way that the transmission shaft (35) carrying the disc (40) is associated with the short-stroke crankshaft (5). When the short-stroke crankshaft is mounted in the bearing housings of the cylinder housing, the sleeve (36), fitted with its mechanical components (15, 36, 39, 41, 43, 45, 51), is fastened onto the disc (40) of the transmission shaft (35), at the same time as the bearing plate (15) is fastened, through the orifice provided, into the cylinder housing, (1). It follows from a mounting of this kind that the crank of the short-stroke crankshaft is fastened axially by the bearing (39), whilst the sleeve (36) is radially maintained by all the bearing housings of the short-stroke crankshaft in relation to the bearing (39).

Inasmuch as the multiple walls enclosing the coolant liquid between the two paired cylinders in the form of an inverted V end in a single wall at the level of the junction of the top dead centres of the said cylinders, the said wall is put to profitable use to be widened in the form of a more or less rectangular channel up to the cylinder head plane. The passage of the gases between the two paired cylinders via the said channel also makes it possible to provide a specific combustion chamber common to these said cylinders.

In preferred and illustrated embodiments the channels, (32) are located only in the body of the cylinder housing and partially in the cylinder head gasket or in the thickness of the said cylinder head gasket.

Fixed compression ratio engines are advantageously standardised to rotate clockwise, the direction of rotation being looked at from the front of the motor. By definition, the front of the motor is located at the side opposite to the side on which the flywheel of the engine is located. The exit layout of the exhaust pipes on the left-hand side or the right-hand side of an engine block in line cannot interfere with the orientation of the distribution of the cylinders, so consequently the distribution invariably remains orientated from the front of the engine towards the rear.

As with the fixed compression ratio engine, the direction of rotation of the variable compression ratio engine is looked at from the front of the engine, and here too the front of the engine is located on the opposite side to the side on which the flywheel of the engine is located. Unlike combustion engines with a fixed compression ratio, the elements of the variable compression ratio engine can be optimised using various mechanical arrangements within the cylinder housing, in such a manner that the exhaust outlets via the cylinder head can be located either on one side or on the other side of the cylinder housing. Depending on the choice of these locations, the engine can either develop in a clockwise direction, with a cylinder distribution orientated from the front towards the rear, like the standardised distribution of a fixed compression ratio engine, or the motor can develop in an anti-clockwise direction, with a cylinder distribution orientated from the rear towards the front of the engine.

Figure 9:
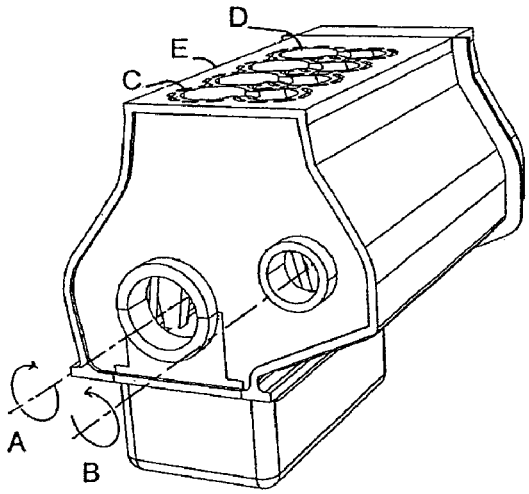
FIGS. 9 to 12 are schematic view of the cylinder housing of various engine.

According to invention, in conformity with a first configuration of the variable compression ratio engine shown in FIG. 9 (only the cylinder housing with the oil sump are drawn), the long-stroke crankshaft is mounted on the left-hand side, looked at from the front of the engine, and the said crankshaft rotates in a clockwise direction. The shaft of the long-stroke crankshaft is fitted with an engine flywheel and with a crown to put the engine into operation. The short-stroke crankshaft is mounted on the right-hand side, looked at from the front of the engine, and develops in an anti-clockwise direction, at the same speed as the long-stroke crankshaft. The order of distribution of the cylinders is orientated from the front to the rear of the engine, in such a manner that the first cylinder is located at the front of the engine and the last cylinder is located at the rear of the engine. The said layout can be adapted to reduce the wear on the cylinders of one or both crankshafts, and also to reduce the piston rod angle during the descending phase of the pistons. To this end, the reduction of the piston rod angle can be implemented by misaligning one or both of the two crankshafts in relation to their cylinders, the misaligning of the crankshaft being brought about on the opposite side where the counterweight is situated during the relaxation phase of the piston. The effect of the said layout is to free an angular space between the two couplings, this free space being put to good use to allow a reduction of the angular portion between the two banks of cylinders and, in the same proportion, the angles formed by the truncated sections of the pistons.

According to invention, in conformity with a second configuration of the variable compression ratio engine (shown in FIG. 10, (only the cylinder housing with the oil sump are drawn), the long-stroke crankshaft is mounted on the right-hand side, looked at from the front of the engine. The shaft of the said crankshaft rotates in a clockwise direction. The long-stroke crankshaft is fitted with an engine flywheel and with a crown to put the engine into operation. The short-stroke crankshaft is mounted on the left-hand side, looked at from the front of the engine, and develops in an anti-clockwise direction, with a speed equal to that of the long-stroke crankshaft. The order of distribution of the cylinders is orientated from the front towards the rear of the engine, in such a manner that the first cylinder is located at the front of the engine and the last cylinder is located at the rear of the engine. The said layout can be adapted to reduce the wear on the cylinders of one or both crankshafts, and also to reduce the piston rod angle during the descending phase of the pistons. To this end, the reduction of the piston rod angle can also be implemented by misaligning one or both crankshafts in relation to their cylinders. The misaligning of the crankshaft is brought about on the opposite side where the counterweight is located during the relaxation phase of the pistons. The afore-mentioned misaligning requires more angular space between the two banks of cylinders, together with a larger angular portion of the truncated section of the pistons.

According to invention, in conformity with a third configuration of the variable compression ratio engine (see FIG. 11, (only the cylinder housing with the oil sump are drawn), the long-stroke crankshaft is mounted on the left-hand side, looked at from the front of the engine. The shaft of the long-stroke crankshaft rotates in an anti-clockwise direction. The shaft of the long-stroke crankshaft is fitted with a flywheel and with a crown for putting the engine into operation with a starter. The short-stroke crankshaft is mounted on the right-hand side, looked at from the front of the engine, and develops in a clockwise direction, at a speed equal to that of the long-stroke crankshaft. The order of distribution of the cylinders is orientated from the rear towards the front of the engine, in such a manner that the first cylinder is located at the rear of the engine and the last cylinder is located at the front of the engine. The said layout can be adapted to reduce the wear on the cylinders of one or both crankshafts, and also to reduce the piston rod angle during the descending phase of the pistons. To this end, the piston rod angle can also be reduced by misaligning one or both of the two crankshafts in relation to their cylinders. The crankshaft is misaligned on the opposite side where the counterweight is located during the relaxation phase of the pistons. The above-mentioned misaligning requires more angular space between the two banks of cylinders, together with a larger angular portion of the truncated section of the pistons.

Figure 12:
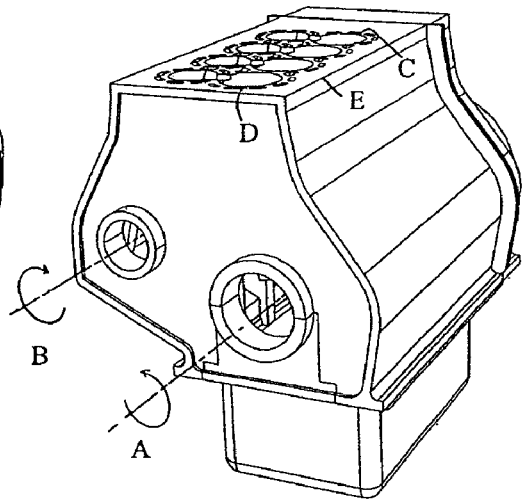

According to invention, in conformity with a fourth configuration of the variable compression ratio engine (see FIG. 12, only the cylinder housing with the oil sump are drawn), the long-stroke crankshaft is mounted on the right-hand side, looked at from the front of the engine. The shaft of the said crankshaft rotates in anti-clockwise direction. The shaft of the long-stroke crankshaft is fitted with an engine flywheel and with a crown for putting the engine into operation. The short-stroke crankshaft is mounted on the left-hand side, looked at from the front of the engine, and rotates in a clockwise direction, with a speed equal to that of the long-stroke crankshaft. The order of distribution of the cylinders is orientated from the rear towards the front of the engine, in such a manner that the first cylinder is located at the rear of the engine and the last cylinder is located at the front of the engine. The said layout can be adapted to reduce the wear on the cylinders of one or both crankshafts. It can also reduce the piston rod angle during the descending phase of the pistons. To this end, the piston rod angle can be reduced by misaligning one or both of the crankshafts in relation to their cylinders. The misaligning of the crankshaft is carried out on the opposite side, where the counterweight is situated during the relaxation phase of the piston. The effect of the said layout is to release an angular space between the two couplings, this free space being made use of to allow a reduction of the angular portion between the two banks of cylinders and pro rata in the angles formed by the truncated sections of the pistons.

In order to avoid inertial stresses between the two crankshafts, the shaft of the small crankshaft is not provided with the flywheel. Advantageously the volume of the cylinder with the smaller diameter is about 2/5 the volume of the cylinder with the larger diameter, while the value of engine torque generated by the small crankshaft is reduced to 2/7 or approximately 28% of total engine torque by the two crankshafts.

Each pair of cylinders is advantageously grouped in the alignment of cross-cylinder crankcase, resulting in a better balance of internal stresses or tensions and a constructive simplification of the latter.

As the increase in boost pressure, it made a better distribution of instantaneous torque between the two crankshafts.

What I claim is:

1. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, and in which the variably timed transmission includes an element selected from the group comprising of a tube and a shaft, said element sliding axially in relation to the rotational axis of the crankshaft of the pistons of the cylinders of the second series for generating a movement travel of the variably timed transmission, the engine comprising at least one stop means to limit the movement travel of the variably timed transmission between a start-of-stroke and an end-of-stroke.

2. The engine of claim 1, in which, for each pair of cylinders connected to one another by a channel, the axis of a large cylinder from the first series of the pair in question forms a first plane with a straight line parallel to the rotational axis of a crankshaft, whilst the axis of the small cylinder from the second series of the pair in question forms a second plane with a straight line parallel to the rotational axis of a crankshaft, whereby said first and second planes define between themselves an angle lying between 1° and 60°.

3. The engine of claim 1, in which, for each pair of cylinders connected to one another by a channel, the axis of a large cylinder from the first series of the pair in question forms a first plane with a straight line parallel to the rotational axis of a crankshaft, whilst the axis of the small cylinder from the second series of the pair in question forms a second plane with a straight line parallel to the rotational axis of a crankshaft, whereby said first and second planes define between themselves an angle lying between 15° and 45°.

4. The engine of claim 1, in which, for each pair of cylinders connected to one another by a channel, the axis of a large cylinder from the first series of the pair in question forms a first plane with a straight line parallel to the rotational axis of a crankshaft, whilst the axis of the small cylinder from the second series of the pair in question forms a second plane with a straight line parallel to the rotational axis of a crankshaft, distinguished by the fact that said first and second planes define between themselves an angle lying between 1° and 60°, in which a plane is defined by the two rotational axes of the two crankshafts, and in which a median plane is defined between the said first and second planes of a pair of cylinders connected there between by a channel, whereby the median plane of said pair of cylinders is substantially perpendicular to the said plane defined by the two rotational axes of the two crankshafts.

5. The engine of claim 1, in which, for each pair of cylinders connected to one another by a channel, the axis of a large cylinder from the first series of the pair in question forms a first plane with a straight line parallel to the rotational axis of a crankshaft, whilst the axis of the small cylinder from the second series of the pair in question forms a second plane with a straight line parallel to the rotational axis of a crankshaft, distinguished by the fact that said first and second planes define between themselves an angle lying between 1° and 60°, in which a plane is defined by the two rotational axes of the two crankshafts, and in which a median straight line is defined between the said rotational axes, whereby the median plane of said pair of cylinders is substantially perpendicular to said median straight line.

6. The engine of claim 1, in which for each pair of cylinders, the pistons move in their respective cylinders between a top end position adjacent to the cylinder head and a bottom end position away from the cylinder head, whereby in the top end position of the pistons, the pistons define for the pair of cylinders considered a dead volume, whereby the channel located between the two cylinders of said pair of cylinders connected there between by said channel has a volume lying between 1% and 25% of the dead volume of the said pair of cylinders.

7. The engine of claim 1, which comprises a camshaft in mesh, at half speed, with the first crankshaft, so as to connect periodically pairs formed by a large cylinder and a small cylinder connected there between by a channel with intake and exhaust pipes, via intake and exhaust valves, at definite moments of the four-stroke cycle.

8. The engine of claim 1, which comprises a layout for the variably timed transmission, the said layout being adapted to receive, at least in part, a device for controlling a phase angle difference between the first and second lines of crankshafts.

9. The engine of claim 8, in which the first and second crankshafts are associated, respectively, with a first driving wheel and a second driving wheel, whereby a transmission means extends between said driving wheels.

10. The engine of claim 1, in which a cylinder head gasket extends substantially in a plane between the upper face of the cylinder housing and the cylinder head part, whereby, in relation to the cylinder head gasket plane, the axis of the cylinders of the first series of large cylinders is positioned substantially perpendicular to the cylinder head gasket.

11. The engine of claim 10, in which the pistons of the small cylinders of the second series are provided with a boss rectifying the form of the combustion chamber, said boss having at least one face substantially parallel to the cylinder head gasket plane.

12. The engine of claim 11, in which said face substantially parallel to the cylinder head gasket plane has an area equal to at least 25% of the area of the small cylinder of the second series, measured in the cylinder head gasket plane.

13. The engine of claim 1, in which the cylinder head gasket extends substantially in a plane, whereby, in relation to the cylinder head gasket plane, the axis of the cylinders of the first series of large cylinders is positioned substantially perpendicular to the cylinder head plane, in which the pistons of the small cylinders of the second series are provided with a boss rectifying the form of the combustion chamber, said boss having at least one face substantially parallel to the cylinder head gasket plane, and in which said face substantially parallel to the cylinder head gasket plane has an area equal to at least 40% of the area of the small cylinder of the second series, measured in the cylinder head gasket plane.

14. The engine of claim 1, in which the cylinder head gasket extends substantially in a plane, whereby, in relation to the cylinder head gasket plane, the axis of the cylinders of the first series of large cylinders is positioned substantially perpendicular to the cylinder head plane, in which the pistons of the small cylinders of the second series are provided with a boss rectifying the form of the combustion chamber, said boss having at least one face substantially parallel to the cylinder head gasket plane, and in which said face substantially parallel to the cylinder head gasket plane has an area equal to at least 60% to 90% of the area of the small cylinder of the second series, measured in the cylinder head gasket plane, and in which the piston of the cylinders of the first series has a face substantially parallel to the cylinder head gasket plane, the said face having a hollow portion adapted to be opened onto a channel for one pair of cylinders.

15. The engine of claim 1, in which each cylinder from the second series has a cylinder head adapted to receive a part of the piston moving in said cylinder when said piston is at its top dead centre position, said cylinder head being moreover adapted to form, at least partially, when the piston is at its top dead centre, a chamber positioned in the cylinder head, communicating with the channel.

16. The engine of claim 1, in which the cylinders of the first series have each a central axis, while the cylinders of the second series have each a central axis, whereby said central axes of the cylinders of the first series and of the second series are not positioned perpendicularly to the upper face of the cylinder housing.

17. The engine of claim 1, which comprises an engine flywheel orientated around and fastened to an end of the crankshaft of the pistons of the cylinders of the first series.

18. The engine of claim 1, which comprises a control cylinder controlling an axial displacement of the sliding element selected from the group comprising of a tube and a shaft, said control cylinder being associated with stop means to limit the axial displacement of the sliding element between the said start-of-stroke and end-of-stroke.

19. The engine of claim 1, in which the two crankshafts are associated with gears in direct contact, whereby the shafts are adapted to turn in opposite rotational directions and at the same speed.

20. The engine of claim 1, which comprises a control cylinder varying a relative angular position between the two crankshafts of the first and second series of cylinders, without passing through an engine flywheel positioned at an end of the engine.

21. The engine of claim 1, for which the crank of the first crankshaft of the first series of cylinders passes through a top dead centre and a bottom dead centre during its rotation, in which the two crankshafts of the first and second series of cylinders are arranged to define a minimum working space for the two crankshafts, in such a way that a minimal ratio is obtained between the displacements of two paired cylinders and in which the variably timed transmission travels between a start-of-travel position and an end-of-travel position, the minimum compression ratio of the paired cylinders being obtained at the end-of-travel of the variably timed transmission and calculated according to the following formula:

$$\frac{V1 + [V2 - Vr(\alpha\text{maximum})] + ve}{ve + Va(\alpha\text{maximum})} = P\ \text{minimum}$$

in which

V1: displacement of the larger cylinder of the paired cylinders;

V2: displacement of the smaller cylinder of the paired cylinders;

Ve: volume of the clearance space of the paired cylinders required for gas transfer between the cylinders, without excessive lamination;

(α maximum): lead angle of the crank of the second crankshaft, at the end-of-travel of the variably timed transmission;

Vr(α maximum): compressed air volume at the end-of-travel of the variably timed transmission, defined by the lead angle of the crank of the second crankshaft, when the crank of the first crankshaft is located at its bottom dead centre, at the end of the intake phase;

Va(α maximum): additional volume added to the clearance space volume, at the end-of-travel of the variably timed transmission, defined by the lead angle of the crank of the second crankshaft, when the crank of the first crankshaft is located at its top dead centre, at the end of the compression phase.

22. The engine of claim 1, which is a four-stroke internal combustion engine, whereby said engine has a ratio between the displacements of the two paired cylinders of between 1/5 and 3/5.

23. The engine of claim 1, which is a four-stroke internal combustion engine, said engine further comprising an oil sump which completely houses the two crankshafts via a top of the cylinder housing.

24. The engine of claim 1, which is a four-stroke internal combustion engine, said engine further comprising a variably timed transmission control cylinder, the said variably timed transmission being situated at an end of the engine.

25. The engine of claim 1, which is a four-stroke internal combustion engine, said engine further comprising two distinct housings, namely a coupling housing and a cylinder housing, whereby the two above-mentioned housings are assembled side by side, in the axial direction of the crankshafts.

26. The engine of claim 1, which is a four-stroke internal combustion engine, said engine further comprising a coupling housing adjacent to the cylinder housing, whereby the coupling housing and the cylinder housing are assembled side by side, in the axial direction of the crankshafts, by means of a concentric enclosure orientated around the crankshaft of the first series of cylinders.

27. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, and a minimum width determined along the upper face of between 0.5 and 0.8 times the mean of the diameters of the cylinders of the said pair of cylinders.

28. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, whereby said engine further comprises a layout for the variably timed transmission, the said layout being adapted to receive, at least in part, a device for controlling a phase angle difference between the first and second lines of crankshafts, in which the first and second crankshafts are associated, respectively, with a first driving wheel and a second driving wheel, whereby a transmission means extends between said driving wheels, in which an engine flywheel is mounted on the shaft of the first crankshaft, whilst the variably timed transmission is mounted on the shaft of the second crankshaft, and in which the shafts of said first and second crankshafts are adapted for positioning the variably timed transmission next to the engine flywheel, whereby the control for the variably timed transmission includes a directly connected guidance cylinder to monitor the phase angle difference between the second crankshaft and the first crankshaft.

29. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, whereby said engine further comprises a variably timed transmission comprising an assembly separated from the shaft of the second crankshaft, in which the variably timed transmission is fitted with a bearing plate which is fixed by centering in an orifice provided for in the cylinder housing, and in which the variably timed transmission contains a shaft of which one end has external splines, whilst the shaft of the second crankshaft is associated with an element or has a portion with a recess with internal splines adapted to co-operate with the external splines of the shaft to ensure that the shafts are coupled to one another, while still permitting an axial displacement between them.

30. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, in which the cylinder head gasket extends substantially in a plane, whereby, in relation to the cylinder head gasket plane, the axis of the cylinders of the first series of large cylinders is positioned substantially perpendicular to the cylinder head plane, in which the pistons of the small cylinders of the second series are provided with a boss rectifying the form of the combustion chamber, said boss having at least one face substantially parallel to the cylinder head gasket plane, in which said face substantially parallel to the cylinder head gasket plane has an area equal to at least 60% to 90% of the area of the small cylinder of the second series, measured in the cylinder head gasket plane, in which the piston of the cylinders of the first series has a face substantially parallel to the cylinder head gasket plane, the said face having a hollow portion adapted to be opened onto a channel for one pair of cylinders, and in which the variably timed transmission is orientated around an end of the small crankshaft next to the engine flywheel.

31. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series haying a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, and in which in which the variably timed transmission is controlled by a system comprising at least a guidance cylinder in direct contact adapted to monitor a phase angle difference between the short-stroke crankshaft of the second series of cylinders and the long-stroke crankshaft of the first series of cylinders.

32. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, and in which the variably timed transmission comprises a control mechanism adapted to vary a relative lead angle between the crank of the second crankshaft and the crank of the first crankshaft, by means of a hydraulic force amplifier having a controlled thrustor acting on the variably timed transmission, said transmission altering at the end of the compression phase of the piston in the larger cylinder, the compression ratio of the engine between a minimum and a maximum, said minimum and maximum compression ratios depending on:

a) the ratio between the displacement of the larger cylinder and the displacement of the smaller cylinder, and b) the ratio between, on the one hand, the total volume of the smaller cylinder and the larger cylinder and between, on the other hand, the volume of the clearance space and an additional volume created in the smaller cylinder at the end of the compression phase of the piston in the larger cylinder, the variably timed transmission adjusting the lead angle between the crank of the second crankshaft and the crank of the first crankshaft, so as to obtain said compression ratios, said lead angle varying between a maximum so that an angle of at least 90° is obtained between the connecting rod of the piston in the smaller cylinder and the crank of the second crankshaft, at the end of the compression phase of the piston in the larger cylinder, in order to define the minimum compression ratio, and a minimum so that the lead angle corresponds, at the end of the compression phase of the piston in the larger cylinder, to the appropriate position of the piston in the smaller cylinder to create the additional volume required to obtain the maximum compression ratio, the crank of the second crankshaft forming an angle with the connecting rod of the piston in the smaller cylinder.

33. The engine of claim 32, in which the variably timed transmission includes three superimposed concentric elements, namely an internal element made up of a transmission shaft, an external element made up of a sleeve carrying a gear for the coupling of the two crankshafts, and an intermediate element positioned between the said internal and external elements and made up of a tube which is sliding in relation to the said internal and external elements, the sleeve being maintained in a bearing plate, by means of a bearing, in which the second crankshaft has a shaft, one end of which is abutting with one end of the transmission shaft, the said ends having corresponding male and female splines to make it possible to couple them, and the three elements are self-centred in relation to the shaft of the second crankshaft during the fastening of the bearing plate onto an orifice of the cylinder housing, allowing for the removal of the transmission without removing the second crankshaft, in which a bearing housing carries a fastening ring forming a seating for an external ring of a bearing, said bearing having an internal ring fastened onto the sleeve in such a way as to maintain the transmission shaft, in which a spacer extends between the internal ring of the bearing and the internal ring of the bearing, this spacer compensating for the separation space between the said rings and axially maintaining the bearing ring of the bearing against a shoulder of the sleeve, in which a single nut ensures the fastening of the internal rings, of the bearings and of the spacer on the sleeve, in which the transmission shaft has, on the fastening ring side, straight splines onto which the sliding tube is engaged, having straight splines on its internal face, in such a way as to slide linearly on the transmission shaft, in which the sleeve has helical splines on its internal face, in which the sliding tube has one end permanently free outside the sleeve, the said end being interdependent with an internal ring of a two-row angular contact bearing, the said bearing having an external ring which is interdependent with a holding member on the cylinder, and in which the helical splines are arranged in such a way that the sliding tube, in being displaced outside the sleeve, reduces the angular feed of the crank of the second crankshaft in relation to the crank of the first crankshaft or vice versa.

34. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, in which the crank of the first crankshaft of the first series of cylinders passes tbrough a top dead centre and a bottom dead centre during its rotation, in which the two crankshafts of the first and second series of cylinders are arranged to define a minimum working space for the two crankshafts, in such a way that a minimal ratio is obtained between the displacements of two paired cylinders and in which the variably timed transmission travels between a start-of-travel position and an end-of-travel position, the minimum compression ratio of the paired cylinders being obtained at the end-of-travel of the variably timed transmission and calculated according to the following formula:

$$\frac{V1 + [V2 - Vr(\alpha\text{maximum})] + ve}{ve + Va(\alpha\text{maximum})} = P\text{minimum}$$

in which

V1: displacement of the larger cylinder of the paired cylinders;

V2: displacement of the smaller cylinder of the paired cylinders

Ve: volume of the clearance space of the paired cylinders required for gas transfer between the cylinders, without excessive lamination;

($\alpha$ maximum): lead angle of the crank of the second crankshaft, at the end-of-travel of the variably timed transmission;

Vr($\alpha$ maximum): compressed air volume at the end-of-travel of the variably timed transmission, defined by the lead angle of the crank of the second crankshaft, when the crank of the first crankshaft is located at its bottom dead centre, at the end of the intake phase;

Va($\alpha$ maximum): additional volume added to the clearance space volume, at the end-of-travel of the variably timed transmission, defined by the lead angle of the crank of the second crankshaft, when the crank of the first crankshaft is located at its top dead centre, at the end of the compression phase, and in which the variably timed transmission includes three superimposed concentric elements, namely an internal element made up of a transmission shaft, an external element made up of a sleeve carrying a gear for the coupling of the two crankshafts, and an intermediate element positioned between the said internal and external elements and made up of a tube which is sliding in relation to the said internal and external elements, the sleeve being maintained in a bearing plate, by means of a bearing, in which the second crankshaft has a shaft, one end of which is abutting with one end of the transmission shaft, the said ends having corresponding male and female splines to make it possible to couple them, and the three elements are self-centred in relation to the shaft of the second crankshaft during the fastening of the bearing plate onto an orifice of the cylinder housing, allowing for the removal of the transmission without removing the second crankshaft, in which a bearing housing carries a fastening ring forming a seating for an external ring of a bearing, said bearing having an internal ring fastened onto the sleeve in such a way as to maintain the transmission shaft, in which a spacer extends between the internal ring of the bearing and the internal ring of the bearing, this spacer compensating for the separation space between the said rings and axially maintaining the bearing ring of the bearing against a shoulder of the sleeve, in which a single nut ensures the fastening of the internal rings, of the bearings and of the spacer on the sleeve, in which the transmission shaft has, on the fastening ring side, straight splines onto which the sliding tube is engaged, having straight splines on its internal face, in such a way as to slide linearly on the transmission shaft, in which the sleeve has helical splines on its internal face, in which the sliding tube has one end permanently free outside the sleeve, the said end being interdependent with an internal ring of a two-row angular contact bearing, the said bearing having an external ring which is interdependent with a holding member on the cylinder, and in which the helical splines are arranged in such a way that the sliding tube, in being displaced outside the sleeve, reduces the angular feed of the crank of the second crankshaft in relation to the crank of the first crankshaft or vice versa.

35. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, whereby said engine is a four-stroke internal combustion engine, said engine further comprising an oil sump positioned beneath the crankshaft of the cylinders of the first series, while the crankshaft of the pistons of the cylinders of the second series is enclosed in the cylinder housing above one face of the housing and at a level located above the oil sump, the said face being inclined towards the oil sump, said inclined face of the cylinder housing being advantageously fitted with an access panel for the crankshaft of the pistons of the cylinders of the second series.

36. A four-stroke internal combustion engine having the following successive phases: an intake phase, a compression phase, an expansion phase and an exhaust phase, said engine operating by a combustion selected from the group comprising of self-combustion, controlled ignition and combinations thereof, whereby said engine includes:

a cylinder housing component having:

a first series of cylinders, each having an axis and a diameter, and a second series of cylinders, each having an axis and diameter, whereby the cylinders of the first series having a larger diameter than the diameter of the cylinders of the second series, and whereby the cylinder housing has an upper face along which the cylinders are open, a cylinder head part covering at least partly the upper face of the cylinder housing component, said cylinder head part being associated at least with inlet valves and exhaust valves at least for the first series of cylinders, a first series of pistons, each piston of said first series being adapted to be driven by an alternative movement in a cylinder of the first series of cylinders along a displacement length, each of said pistons being associated with a connecting rod, a second series of pistons, each piston of said second series being adapted to be driven by an alternative movement in a cylinder of the second series of cylinders along a displacement length, each of said pistons being associated with a connecting rod, whereby the displacement length of the piston of the cylinder of the first series is larger than the displacement length of the piston of the cylinder of the second series, a first crankshaft and a second crankshaft with rotational axes parallel to one another, the first crankshaft having a crank with a large stroke, whilst the second crankshaft has a crank with a small stroke, less than the large stroke of the crank of the first crankshaft, the said crankshafts being adapted to be coupled at the same rotational speed, by a gear train and a variably timed transmission;

at least one variably timed transmission acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod, is operated by a crank of a crankshaft, the crank with the small stroke of the second crankshaft operating the rod of the piston moving within the small cylinder, whilst the crank with the large stroke of the first crankshaft operates the rod of the piston moving within the large cylinder, in which the first series of cylinders is laid out above the first crankshaft, whilst the second series of cylinders is laid out above the second crankshaft, in which each cylinder of the first series communicates with at least one cylinder of the second series via a clearance space, in such a way as to form a pair of two cylinders communicating with one another to allow the gases to pass from one cylinder to the other, independently of the position of the pistons moving within the said cylinders, and in which the upper face of the cylinder housing component is provided with channels forming distinct passages for each pair of cylinders, a channel for one pair of cylinders extending between a cylinder from the first series and a cylinder from the second series, whereby each channel for one pair of cylinders has a mean width determined along the upper face of between 0.5 and 0.8 times the mean of the diameters of the cylinders of the said pair of cylinders, whereby said engine is a four-stroke internal combustion engine, whereby the cylinder housing comprises a coupling housing part, and whereby the engine further comprises an oil sump located beneath the cylinder housing.

37. A machine comprising a four-stroke internal combustion engine having an intake phase, a compression phase, an expansion phase and an exhaust phase, said engine operating by self-combustion or by controlled ignition, including:

a cylinder housing component having a first series of cylinders, each having an axis and a diameter, and a second series of cylinders (3), each having an axis and diameter, the cylinders (2) of the first series having a larger displacement and diameter than the displacement and the diameter of the cylinders (3) of the second series (3), pistons (6,8), each piston being adapted to be driven by an alternative movement in a cylinder and being associated with a connecting rod, two crankshafts with rotational axes parallel to one another, a first crankshaft (4) having a crank with a large stroke, whilst a second crankshaft (5) has a crank with a small stroke, less than the long stroke of the crank of the first crankshaft, the said crankshafts (4,5) being adapted to be coupled at the same rotational speed, by at least a gear train (14,16), at least one variably timed transmission (10) acting on an element selected from the group comprising of the crankshafts, pieces connected to the crankshafts and pieces of the gear train adapted for coupling the crankshafts at the same rotational speed, said variably timed transmission being adapted for adjusting at least a relative angular position between the crankshafts, said relative angular position between the crankshafts being defined by the angle formed between the crank of the first crankshaft and a line parallel to the crank of the second crankshaft and crossing the rotational axis of the first crankshaft;

in which each piston, being associated with a connecting rod (7,9), is operated by a crank of a crankshaft, the short-stroke handle of the second crankshaft (5) operating the rod (9) of the piston (8) moving within the small cylinder (3), whilst the large-stroke crank of the first crankshaft (4) operates the lever (7) of the piston (6) moving within the large cylinder (2), in which the first series of cylinders (2) is laid out above the first crankshaft (4), whilst the second series of cylinders (3) is laid out above the second crankshaft (5), in which each cylinder (2) of the first series communicates with at least one cylinder (3) of the second series via a clearance space, in such a way as to form a pair of two cylinders (2,3) communicating with one another to allow the gases to pass from one cylinder to the other, independently of the position of the pistons (6,8) moving within the said cylinders (2,3), in which the cylinder housing component displays a face along which the cylinders are open, channels being formed in the said face to form distinct passages for each pair of cylinders, a channel for one pair of cylinders extending between a large cylinder from the first series and a small cylinder from the second series, said channel having a width determined at said face selected from the group comprising of a mean width and a minimal width of between 0.5 and 0.8 times the mean of the diameters of the cylinders connected by the said channel, and in which the variably timed transmission includes an element selected from the group comprising of a tube and a shaft, said element sliding axially in relation to the rotational axis of the crankshaft of the pistons of the cylinders of the second series for generating a movement travel of the variably timed transmission, the engine comprising at least one stop means to limit the movement travel of the variably timed transmission between a start-of-stroke and an end-of-stroke.

* * * * *